US009205967B2

(12) United States Patent
Renders et al.

(10) Patent No.: US 9,205,967 B2
(45) Date of Patent: Dec. 8, 2015

(54) RESEALABLE PACKAGING FOR FOOD PRODUCTS AND METHOD OF MANUFACTURING

(75) Inventors: Eddy Renders, Westerlo (BE); Rene Verhaegen, Kalmthout (BE); Peter Looymans, Geel (BE)

(73) Assignee: GENERALE BISCUIT, Rungis (FR)

( * ) Notice: Subject to any disclaimer, the term of this patent is extended or adjusted under 35 U.S.C. 154(b) by 156 days.

(21) Appl. No.: 13/575,470

(22) PCT Filed: Jan. 26, 2011

(86) PCT No.: PCT/EP2011/051008
§ 371 (c)(1),
(2), (4) Date: Sep. 21, 2012

(87) PCT Pub. No.: WO2011/092171
PCT Pub. Date: Aug. 4, 2011

(65) Prior Publication Data

US 2013/0004626 A1 Jan. 3, 2013

(30) Foreign Application Priority Data

Jan. 26, 2010 (EP) ..... 10305091

(51) Int. Cl.
*B65D 33/00* (2006.01)
*B65D 75/58* (2006.01)
*B65D 33/02* (2006.01)

(52) U.S. Cl.
CPC ..... *B65D 75/5838* (2013.01); *B65D 33/02* (2013.01); *B65D 2575/586* (2013.01)

(58) Field of Classification Search
CPC ..... B65D 77/003; B65D 75/5838; B65D 2575/586; B65D 33/02
USPC ..... 383/203, 205, 207–209, 66, 119; 229/87.05, 87.08, 87.09
See application file for complete search history.

(56) References Cited

U.S. PATENT DOCUMENTS 401,974 A 4/1889 Smith
811,092 A 1/1906 Roberts
(Continued)

FOREIGN PATENT DOCUMENTS

AU 768679 6/2001
BR 55008852 11/2001
(Continued)

OTHER PUBLICATIONS

'Cheese Range', Mintel gnpd, Jan. 26, 2001, Mintel Publishing, 1 page.
(Continued)

*Primary Examiner* — Jes F Pascua
(74) *Attorney, Agent, or Firm* — Fitch, Even, Tabin & Flannery LLP

(57) ABSTRACT

Resealable packaging for food products is provided with a flexible container having a top face and side faces. A container aperture is disposed in the top face and a flexible closure flap extends from a base portion to a gripping member, and is provided with a movable portion covered of repositionable adhesive to cover the aperture and adhere to a peripheral area thereof in a closed position. The packaging comprises a stiffening band device made of a flexible material longer than the closure flap, which is bonded to the container through the top face and over two side faces and arranged to cover at least the portions of the peripheral area comprised between the longitudinal sides of the closure flap and the facing sides of the aperture. The aperture and the band device are delimited by continuous cut out lines. A method of manufacturing is also disclosed.

23 Claims, 7 Drawing Sheets

(56) References Cited

U.S. PATENT DOCUMENTS 1,065,012 A 6/1913 Watanabe
1,106,721 A 8/1914 Lewis
1,171,462 A 2/1916 Rice
1,791,352 A 2/1931 Pascual
1,963,639 A 12/1931 Ahlquist
1,949,161 A 6/1932 Haug
1,978,035 A 9/1932 Thom
2,033,550 A 3/1936 Rosen
2,034,007 A 3/1936 Smith
2,066,495 A 1/1937 Swift
2,079,328 A 5/1937 McBean
2,128,196 A 8/1938 Max
2,248,578 A 7/1941 Moore
2,260,064 A * 10/1941 Stokes ..... 53/415
2,320,143 A 5/1943 Johnson
2,321,042 A 6/1943 Preis
2,330,015 A * 9/1943 Stokes ..... 383/109
2,621,788 A 10/1948 Hitchcock
2,475,236 A 7/1949 Matthew
2,605,897 A 10/1949 Rundle
2,554,160 A 5/1951 Von
2,684,807 A 7/1954 Gerrish
2,719,647 A 10/1955 Freeman
2,823,795 A 2/1958 Moore
2,965,224 A 12/1960 Harwood
3,080,238 A 3/1963 Howard
3,127,273 A 3/1964 Monahan
3,179,326 A 4/1965 Underwood
3,186,628 A 6/1965 Rohde
3,187,982 A 6/1965 Underwood
3,217,871 A 11/1965 Lee
3,235,165 A 2/1966 Jackson
3,245,525 A 4/1966 Shoemaker
3,259,303 A 7/1966 Repko
3,260,358 A 7/1966 Gottily
3,272,422 A 9/1966 Miller
3,291,377 A 12/1966 Eggen
3,298,505 A 1/1967 Stephenson
3,311,032 A 3/1967 Lucas
3,326,450 A 6/1967 Langdon
3,331,501 A 7/1967 Stewart
3,343,541 A 9/1967 Bellamy
3,373,922 A 3/1968 Watts
3,373,926 A 3/1968 Voigtman
3,454,210 A 7/1969 Spiegel
3,471,005 A 10/1969 Sexstone
3,520,401 A 7/1970 Richter
3,528,825 A 9/1970 Doughty
3,570,751 A 3/1971 Trewella
3,595,466 A 7/1971 Rosenburg
3,595,468 A 7/1971 Repko
3,618,751 A 11/1971 Rich
3,630,346 A 12/1971 Burnside
3,651,615 A 3/1972 Bohner
3,653,502 A 4/1972 Beaudoin
3,685,720 A 8/1972 Brady
3,687,352 A 8/1972 Kalajian
3,740,238 A 6/1973 Graham
3,757,078 A 9/1973 Conti
3,790,744 A 2/1974 Bowen
3,811,564 A 5/1974 Braber
3,865,302 A 2/1975 Kane
3,885,727 A 5/1975 Gilley
3,905,646 A 9/1975 Brackmann
3,909,582 A 9/1975 Bowen
3,910,410 A 10/1975 Shaw
3,938,659 A 2/1976 Wardwell
3,966,046 A 6/1976 Deutschlander
3,971,506 A 7/1976 Roenna
3,979,050 A 9/1976 Cilia
4,082,216 A * 4/1978 Clarke ..... 229/164.1
4,113,104 A 9/1978 Meyers
4,140,046 A 2/1979 Marbach
4,143,695 A 3/1979 Hoehn
4,156,493 A 5/1979 Julius
4,185,754 A 1/1980 Julius
4,192,420 A 3/1980 Worrell, Sr.
4,192,448 A 3/1980 Porth
4,197,949 A 4/1980 Carlsson
4,210,246 A 7/1980 Kuchenbecker
4,258,876 A 3/1981 Ljungcrantz
4,260,061 A 4/1981 Jacobs
4,273,815 A 6/1981 Gifford
4,285,681 A 8/1981 Walitalo
4,306,367 A 12/1981 Otto
4,337,862 A 7/1982 Suter
4,364,478 A 12/1982 Tuns
4,397,415 A 8/1983 Lisiecki
4,411,365 A 10/1983 Horikawa
4,420,080 A 12/1983 Nakamura
4,428,477 A 1/1984 Cristofolo
4,460,088 A 7/1984 Rugenstein
4,464,154 A 8/1984 Ljungcrantz
4,488,647 A 12/1984 Davis
4,506,488 A 3/1985 Matt et al.
4,518,087 A 5/1985 Goglio
4,538,396 A 9/1985 Nakamura
4,545,844 A 10/1985 Buchanan
4,548,824 A 10/1985 Mitchell
4,548,852 A 10/1985 Mitchell
4,549,063 A 10/1985 Ang
4,550,831 A 11/1985 Whitford
4,552,269 A 11/1985 Chang
4,557,505 A 12/1985 Schaefer
4,570,820 A 2/1986 Murphy
4,572,377 A 2/1986 Beckett
4,608,288 A 8/1986 Spindler
4,610,357 A 9/1986 Nakamura
4,613,046 A 9/1986 Kuchenbecker
4,616,470 A 10/1986 Nakamura
4,625,495 A 12/1986 Holovach
4,638,911 A 1/1987 Prohaska
4,648,509 A 3/1987 Alves
4,651,874 A 3/1987 Nakamura
4,653,250 A 3/1987 Nakamura
4,658,963 A 4/1987 Jud
4,667,453 A 5/1987 Goglio
4,671,453 A 6/1987 Cassidy
4,673,085 A 6/1987 Badouard
4,679,693 A 7/1987 Forman
4,694,960 A 9/1987 Phipps
4,696,404 A 9/1987 Corella
4,709,399 A 11/1987 Sanders
4,723,301 A 2/1988 Chang
4,738,365 A 4/1988 Prater
4,739,879 A 4/1988 Nakamura
4,770,325 A 9/1988 Gordon
4,784,885 A 11/1988 Carespodi
4,790,436 A 12/1988 Nakamura
4,798,295 A 1/1989 Rausing
4,798,296 A 1/1989 Lagerstedt
4,799,594 A 1/1989 Blackman
4,811,848 A 3/1989 Jud
4,818,120 A 4/1989 Addiego
4,838,429 A 6/1989 Fabisiewicz
4,840,270 A 6/1989 Caputo
4,845,470 A 7/1989 Boldt
4,848,575 A 7/1989 Nakamura
4,858,780 A 8/1989 Odaka
4,863,064 A 9/1989 Dailey
4,865,198 A 9/1989 Butler
4,866,911 A 9/1989 Grindrod
4,874,096 A 10/1989 Tessera-Chiesa
4,876,123 A 10/1989 Rivera
4,889,731 A 12/1989 Williams
4,901,505 A 2/1990 Williams, Jr.
4,902,142 A 2/1990 Lammert
4,917,247 A 4/1990 Jud
4,943,439 A 7/1990 Andreas
4,972,953 A 11/1990 Friedman
4,998,666 A 3/1991 Ewan
4,999,081 A 3/1991 Buchanan
5,000,320 A 3/1991 Kuchenbecker
5,001,325 A 3/1991 Huizinga

(56) References Cited

U.S. PATENT DOCUMENTS

| | | | |
|---|---|---|---|
| 5,005,264 | A | 4/1991 | Breen |
| 5,010,231 | A | 4/1991 | Huizinga |
| 5,018,625 | A | 5/1991 | Focke |
| 5,029,712 | A | 7/1991 | OBrien |
| 5,040,685 | A | 8/1991 | Focke |
| 5,046,621 | A | 9/1991 | Bell |
| 5,048,718 | A | 9/1991 | Nakamura |
| 5,054,619 | A | 10/1991 | Muckenfuhs |
| 5,060,848 | A | 10/1991 | Ewan |
| 5,065,868 | A | 11/1991 | Cornelissen et al. |
| 5,076,439 | A | 12/1991 | Kuchenbecker |
| 5,077,064 | A | 12/1991 | Hustad |
| 5,078,509 | A | 1/1992 | Center |
| 5,082,702 | A | 1/1992 | Alband |
| 5,085,724 | A | 2/1992 | Focke |
| 5,096,113 | A | 3/1992 | Focke |
| 5,100,003 | A | 3/1992 | Jud |
| 5,103,980 | A | 4/1992 | Kuchenbecker |
| 5,108,669 | A | 4/1992 | vanDijk |
| 5,124,388 | A | 6/1992 | Pruett |
| 5,125,211 | A | 6/1992 | OBrien |
| 5,134,001 | A | 7/1992 | Osgood |
| 5,158,499 | A | 10/1992 | Guckenberger |
| 5,161,350 | A | 11/1992 | Nakamura |
| 5,167,455 | A | 12/1992 | Forman |
| 5,167,974 | A | 12/1992 | Grindrod |
| 5,174,659 | A | 12/1992 | Laske |
| 5,184,771 | A | 2/1993 | Jud |
| 5,190,152 | A | 3/1993 | Smith |
| 5,197,618 | A | 3/1993 | Goth |
| 5,222,422 | A | 6/1993 | Benner |
| 5,222,813 | A | 6/1993 | Kopp |
| 5,229,180 | A | 7/1993 | Littmann |
| 5,294,470 | A | 3/1994 | Ewan |
| 5,307,988 | A | 5/1994 | Focke |
| 5,333,735 | A | 8/1994 | Focke |
| 5,344,007 | A | 9/1994 | Nakamura |
| 5,352,466 | A | 10/1994 | Delonis |
| 5,356,068 | A | 10/1994 | Moreno |
| 5,366,087 | A | 11/1994 | Bane |
| 5,371,997 | A | 12/1994 | Kopp |
| 5,374,179 | A | 12/1994 | Swanson |
| 5,375,698 | A | 12/1994 | Ewart |
| 5,381,643 | A | 1/1995 | Kazaitis |
| 5,382,190 | A | 1/1995 | Graves |
| 5,388,757 | A | 2/1995 | Lorenzen |
| 5,405,629 | A | 4/1995 | Marnocha |
| 5,407,070 | A | 4/1995 | Bascos |
| 5,409,115 | A | 4/1995 | Barkhorn |
| 5,409,116 | A | 4/1995 | Aronsen |
| 5,439,102 | A | 8/1995 | Brown |
| 5,454,207 | A | 10/1995 | Storandt |
| 5,460,838 | A | 10/1995 | Wermund |
| 5,460,844 | A | 10/1995 | Gaylor |
| 5,461,845 | A | 10/1995 | Yeager |
| 5,464,092 | A | 11/1995 | Seeley |
| 5,470,015 | A | 11/1995 | Jud |
| 5,489,060 | A | 2/1996 | Godard |
| 5,499,757 | A | 3/1996 | Back |
| 5,503,858 | A | 4/1996 | Reskow |
| 5,505,305 | A | 4/1996 | Scholz |
| 5,515,965 | A | 5/1996 | Boldrini |
| 5,519,982 | A | 5/1996 | Herber |
| 5,520,939 | A | 5/1996 | Wells |
| 5,524,759 | A | 6/1996 | Herzberg |
| 5,531,325 | A | 7/1996 | Deflander |
| 5,538,129 | A | 7/1996 | Chester |
| 5,550,346 | A | 8/1996 | Andriash |
| 5,558,438 | A | 9/1996 | Warr |
| 5,582,342 | A | 12/1996 | Jud |
| 5,582,853 | A | 12/1996 | Marnocha |
| 5,582,887 | A | 12/1996 | Etheredge |
| 5,591,468 | A | 1/1997 | Stockley |
| 5,630,308 | A | 5/1997 | Guckenberger |
| 5,633,058 | A | 5/1997 | Hoffer |
| 5,636,732 | A | 6/1997 | Gilels |
| 5,637,369 | A | 6/1997 | Stewart |
| 5,647,100 | A | 7/1997 | Porchia |
| 5,647,506 | A | 7/1997 | Julius |
| 5,664,677 | A | 9/1997 | OConnor |
| 5,688,394 | A | 11/1997 | McBride |
| 5,688,463 | A | 11/1997 | Robichaud |
| 5,702,743 | A | 12/1997 | Wells |
| 5,709,479 | A | 1/1998 | Bell |
| 5,725,311 | A | 3/1998 | Ponsi |
| D394,204 | S | 5/1998 | Seddon |
| D394,605 | S | 5/1998 | Skiba |
| 5,749,657 | A | 5/1998 | May |
| 5,770,283 | A | 6/1998 | Gosselin |
| 5,791,465 | A | 8/1998 | Niki |
| 5,795,604 | A | 8/1998 | Wells |
| 5,819,931 | A | 10/1998 | Boucher |
| 5,820,953 | A | 10/1998 | Beer |
| 5,833,368 | A | 11/1998 | Kaufman |
| 5,855,435 | A | 1/1999 | Chiesa |
| 5,862,101 | A | 1/1999 | Haas |
| 5,873,483 | A | 2/1999 | Goertz |
| 5,873,607 | A | 2/1999 | Waggoner |
| 5,882,116 | A | 3/1999 | Backus |
| 5,885,673 | A | 3/1999 | Light |
| 5,906,278 | A | 5/1999 | Ponsi |
| 5,908,246 | A | 6/1999 | Arimura |
| 5,928,749 | A | 7/1999 | Forman |
| 5,938,013 | A | 8/1999 | Palumbo |
| 5,939,156 | A | 8/1999 | Rossi |
| 5,945,145 | A | 8/1999 | Narsutis |
| 5,956,794 | A | 9/1999 | Skiba |
| 5,993,962 | A | 11/1999 | Timm |
| 5,996,797 | A | 12/1999 | Flaig |
| 5,997,177 | A | 12/1999 | Kaufman |
| 6,006,907 | A | 12/1999 | Sato |
| 6,012,572 | A | 1/2000 | Heathcock |
| 6,015,934 | A | 1/2000 | Lee |
| 6,026,953 | A | 2/2000 | Nakamura |
| 6,028,289 | A | 2/2000 | Robichaud |
| 6,029,809 | A | 2/2000 | Skiba |
| 6,056,141 | A | 5/2000 | Navarini |
| 6,060,095 | A | 5/2000 | Scrimager |
| 6,065,591 | A | 5/2000 | Dill |
| 6,066,437 | A | 5/2000 | Kosslinger |
| 6,076,969 | A | 6/2000 | Jaisle |
| 6,077,551 | A | 6/2000 | Scrimager |
| 6,099,682 | A | 8/2000 | Krampe |
| 6,113,271 | A | 9/2000 | Scott |
| 6,125,614 | A | 10/2000 | Jones |
| 6,126,009 | A | 10/2000 | Shiffler |
| 6,126,317 | A | 10/2000 | Anderson |
| 6,152,601 | A | 11/2000 | Johnson |
| 6,164,441 | A | 12/2000 | Guy |
| 6,213,645 | B1 | 4/2001 | Beer |
| 6,228,450 | B1 | 5/2001 | Pedrini |
| D447,054 | S | 8/2001 | Hill |
| 6,273,610 | B1 | 8/2001 | Koyama |
| 6,279,297 | B1 | 8/2001 | Latronico |
| 6,296,884 | B1 | 10/2001 | Okerfund |
| 6,299,355 | B1 | 10/2001 | Schneck |
| 6,309,104 | B1 | 10/2001 | Koch |
| 6,309,105 | B1 | 10/2001 | Palumbo |
| 6,318,894 | B1 | 11/2001 | Derenthal |
| 6,352,364 | B1 | 3/2002 | Mobs |
| 6,364,113 | B1 | 4/2002 | Faasse |
| 6,365,255 | B1 | 4/2002 | Kittel |
| 6,383,592 | B1 | 5/2002 | Lowry |
| 6,402,379 | B1 | 6/2002 | Albright |
| 6,420,006 | B1 | 7/2002 | Scott |
| 6,427,420 | B1 | 8/2002 | Olivieri |
| 6,428,208 | B1 | 8/2002 | Addison |
| 6,428,867 | B1 | 8/2002 | Scott |
| 6,446,811 | B1 | 9/2002 | Wilfong |
| 6,450,685 | B1 | 9/2002 | Scott |
| 6,457,585 | B1 | 10/2002 | Huffer |
| 6,461,043 | B1 | 10/2002 | Healy |
| 6,461,708 | B1 | 10/2002 | Dronzek |
| 6,471,817 | B1 | 10/2002 | Emmert |

(56) References Cited

U.S. PATENT DOCUMENTS

| | | | |
|---|---|---|---|
| 6,476,743 | B1 | 11/2002 | Brown |
| 6,482,867 | B1 | 11/2002 | Kimura |
| 6,502,986 | B1 | 1/2003 | Bensur |
| 6,517,243 | B2 | 2/2003 | Huffer |
| 6,519,918 | B2 | 2/2003 | Forman et al. |
| 6,539,691 | B2 | 4/2003 | Beer |
| 6,554,134 | B1 | 4/2003 | Guibert |
| 6,563,082 | B2 | 5/2003 | Terada |
| 6,589,622 | B1 | 7/2003 | Scott |
| 6,592,260 | B1 | 7/2003 | Randall |
| 6,594,872 | B2 | 7/2003 | Cisek |
| 6,612,432 | B2 | 9/2003 | Motson |
| 6,616,334 | B2 | 9/2003 | Faaborg |
| 6,621,046 | B2 | 9/2003 | Kaji |
| 6,669,046 | B1 | 12/2003 | Sawada |
| 6,691,886 | B1 | 2/2004 | Berndt |
| 6,698,928 | B2 | 3/2004 | Miller |
| 6,726,054 | B2 | 4/2004 | Fagen |
| 6,726,364 | B2 | 4/2004 | Perell |
| 6,746,743 | B2 | 6/2004 | Knoerzer |
| 6,750,423 | B2 | 6/2004 | Tanaka |
| 6,767,604 | B2 | 7/2004 | Muir |
| 6,815,634 | B2 | 11/2004 | Sonoda |
| 6,852,947 | B2 | 2/2005 | Tanaka |
| 6,865,860 | B2 | 3/2005 | Arakawa |
| 6,889,483 | B2 | 5/2005 | Compton |
| 6,918,532 | B2 | 7/2005 | Sierra-Gomez |
| 6,929,400 | B2 | 8/2005 | Razeti |
| 6,951,999 | B2 | 10/2005 | Monforton |
| 6,969,196 | B2 | 11/2005 | Woodham |
| 6,983,875 | B2 | 1/2006 | Emmott |
| 7,007,423 | B2 | 3/2006 | Andersson |
| 7,021,827 | B2 | 4/2006 | Compton |
| 7,032,754 | B2 | 4/2006 | Kopecky |
| 7,032,757 | B2 | 4/2006 | Richards |
| 7,032,810 | B2 | 4/2006 | Benedetti et al. |
| 7,040,810 | B2 | 5/2006 | Steele |
| 7,048,441 | B2 | 5/2006 | Pape |
| 7,051,877 | B2 | 5/2006 | Lin |
| 7,165,888 | B2 | 1/2007 | Rodick |
| 7,172,779 | B2 | 2/2007 | Castellanos |
| 7,207,718 | B2 | 4/2007 | Machacek |
| 7,207,719 | B2 | 4/2007 | Marbler |
| 7,213,710 | B2 | 5/2007 | Cotert |
| 7,228,968 | B1 | 6/2007 | Burgess |
| 7,254,873 | B2 | 8/2007 | Stolmeier |
| 7,261,468 | B2 | 8/2007 | Schneider |
| 7,262,335 | B2 | 8/2007 | Motsch |
| 7,302,783 | B2 | 12/2007 | Cotert |
| 7,350,688 | B2 | 4/2008 | Sierra-Gomez |
| 7,351,458 | B2 | 4/2008 | Leighton |
| 7,352,591 | B2 | 4/2008 | Sugahara |
| 7,404,487 | B2 | 7/2008 | Kumakura |
| 7,422,142 | B2 | 9/2008 | Arippol |
| 7,470,062 | B2 | 12/2008 | Moteki |
| 7,475,781 | B2 | 1/2009 | Kobayashi et al. |
| 7,516,599 | B2 | 4/2009 | Doll |
| 7,527,189 | B2 | 5/2009 | Billig |
| 7,533,773 | B2 | 5/2009 | Aldridge |
| 7,600,641 | B2 | 10/2009 | Burgess |
| 7,703,602 | B2 | 4/2010 | Saito |
| 7,708,463 | B2 | 5/2010 | Sampaio Camacho |
| 7,717,620 | B2 | 5/2010 | Hebert |
| 7,740,923 | B2 | 6/2010 | Exner |
| 7,758,484 | B2 | 7/2010 | Peterson |
| 7,858,901 | B2 | 12/2010 | Krishnan |
| 2,588,409 | A1 | 7/2011 | Aldridge |
| 7,971,718 | B2 | 7/2011 | Aldridge |
| 8,002,171 | B2 | 8/2011 | Ryan |
| 8,002,941 | B2 | 8/2011 | Exner |
| 8,029,428 | B2 | 10/2011 | Selle |
| 8,038,349 | B2 | 10/2011 | Andersson |
| 8,181,784 | B2 | 5/2012 | Bouthiette |
| 8,240,546 | B2 | 8/2012 | Friebe |
| 8,262,830 | B2 | 9/2012 | Hebert |
| 8,262,832 | B2 | 9/2012 | Hebert |
| 8,506,165 | B2 | 8/2013 | Shinozaki |
| 8,763,890 | B2 | 7/2014 | Clark |
| 8,920,030 | B2 | 12/2014 | McSweeney |
| 8,951,591 | B2 | 2/2015 | Vogt |
| 2001/0000480 | A1 | 4/2001 | Stagg |
| 2002/0000441 | A1 | 1/2002 | Redmond |
| 2002/0068668 | A1 | 6/2002 | Chow |
| 2003/0019780 | A1 | 1/2003 | Parodi |
| 2003/0039412 | A1 | 2/2003 | Rodick |
| 2003/0047695 | A1 | 3/2003 | Zik |
| 2003/0051440 | A1 | 3/2003 | Chow |
| 2003/0053720 | A1 | 3/2003 | Smith |
| 2003/0118255 | A1 | 6/2003 | Miller |
| 2003/0127352 | A1 | 7/2003 | Buschkiel |
| 2003/0170357 | A1 | 9/2003 | Garwood |
| 2003/0183637 | A1 | 10/2003 | Zappa |
| 2003/0183643 | A1 | 10/2003 | Fagen |
| 2003/0210838 | A1 | 11/2003 | Steele |
| 2003/0217946 | A1 | 11/2003 | Hsu |
| 2003/0223656 | A1 | 12/2003 | Razeti |
| 2004/0011677 | A1 | 1/2004 | Arakawa |
| 2004/0035719 | A1 | 2/2004 | Ebbers |
| 2004/0060974 | A1 | 4/2004 | Dacey |
| 2004/0062838 | A1 | 4/2004 | Castellanos |
| 2004/0067326 | A1 | 4/2004 | Knoerzer |
| 2004/0083680 | A1 | 5/2004 | Compton |
| 2004/0091184 | A1 | 5/2004 | Miller |
| 2004/0112010 | A1 | 6/2004 | Richards |
| 2004/0150221 | A1 | 8/2004 | Brown |
| 2004/0175060 | A1 | 9/2004 | Woodham |
| 2004/0180118 | A1 | 9/2004 | Renger |
| 2004/0206637 | A1 | 10/2004 | Sierra-Gomez |
| 2005/0000965 | A1 | 1/2005 | Boardman |
| 2005/0031233 | A1 | 2/2005 | Varanese |
| 2005/0084186 | A1 | 4/2005 | Caris |
| 2005/0116016 | A1 | 6/2005 | LoDuca |
| 2005/0117819 | A1 | 6/2005 | Kingsford |
| 2005/0220371 | A1 | 10/2005 | Machacek |
| 2005/0247764 | A1 | 11/2005 | Sierra-Gomez |
| 2005/0276885 | A1 | 12/2005 | Bennett |
| 2006/0018569 | A1 | 1/2006 | Bonenfant |
| 2006/0066096 | A1 | 3/2006 | Kan |
| 2006/0124494 | A1 | 6/2006 | Clark |
| 2006/0144911 | A1 | 7/2006 | Sierra-Gomez |
| 2006/0171611 | A1 | 8/2006 | Rapparini |
| 2006/0199717 | A1 | 9/2006 | Marbler |
| 2006/0251342 | A1 | 11/2006 | Forman |
| 2006/0257056 | A1 | 11/2006 | Miyake |
| 2006/0257599 | A1 | 11/2006 | Exner |
| 2006/0283750 | A1 | 12/2006 | Villars |
| 2006/0285779 | A1 | 12/2006 | Golas |
| 2007/0023435 | A1 | 2/2007 | Sierra-Gomez |
| 2007/0023436 | A1 | 2/2007 | Sierra-Gomez |
| 2007/0095709 | A1 | 5/2007 | Saito |
| 2007/0140600 | A1 | 6/2007 | Nowak |
| 2007/0209959 | A1 | 9/2007 | Burgess |
| 2007/0269142 | A1 | 11/2007 | Tyska |
| 2007/0275133 | A1 | 11/2007 | Sierra-Gomez |
| 2008/0013869 | A1 | 1/2008 | Forman |
| 2008/0031555 | A1 | 2/2008 | Roberts |
| 2008/0034713 | A1 | 2/2008 | Kohl |
| 2008/0037911 | A1 | 2/2008 | Cole |
| 2008/0041750 | A1 | 2/2008 | Kohlweyer |
| 2008/0053861 | A1 | 3/2008 | Mellin |
| 2008/0060751 | A1 | 3/2008 | Arrindell |
| 2008/0063324 | A1 | 3/2008 | Bernard |
| 2008/0063759 | A1 | 3/2008 | Raymond |
| 2008/0063760 | A1 | 3/2008 | Raymond |
| 2008/0101733 | A1 | 5/2008 | Fenn-Barrabass |
| 2008/0131035 | A1 | 6/2008 | Rogers |
| 2008/0135428 | A1 | 6/2008 | Tallier |
| 2008/0152264 | A1 | 6/2008 | Pokusa |
| 2008/0156861 | A1 | 7/2008 | Sierra-Gomez |
| 2008/0159666 | A1 | 7/2008 | Exner |
| 2008/0199109 | A1 | 8/2008 | Rutzinger |
| 2008/0203141 | A1 | 8/2008 | Friebe |
| 2008/0214376 | A1 | 9/2008 | Bonenfant |
| 2008/0240627 | A1 | 10/2008 | Cole |

(56) References Cited

U.S. PATENT DOCUMENTS

| | | | |
|---|---|---|---|
| 2008/0273821 | A1 | 11/2008 | Doll |
| 2008/0292225 | A1 | 11/2008 | Dayrit |
| 2009/0001143 | A1 | 1/2009 | Cowan |
| 2009/0014491 | A1 | 1/2009 | Fuisz |
| 2009/0022431 | A1 | 1/2009 | Conner |
| 2009/0028472 | A1 | 1/2009 | Andersson et al. |
| 2009/0053372 | A1 | 2/2009 | Hambrick |
| 2009/0074333 | A1 | 3/2009 | Griebel |
| 2009/0097786 | A1 | 4/2009 | Goglio |
| 2009/0161995 | A1 | 6/2009 | Henderson |
| 2009/0190866 | A1 | 7/2009 | Hughes |
| 2009/0211938 | A1 | 8/2009 | Aldridge |
| 2009/0226117 | A1 | 9/2009 | Davis |
| 2009/0232425 | A1 | 9/2009 | Tai |
| 2009/0273179 | A1 | 11/2009 | Scott |
| 2009/0301903 | A1 | 12/2009 | Andersson |
| 2010/0002963 | A1 | 1/2010 | Holbert |
| 2010/0018974 | A1 | 1/2010 | Lyzenga |
| 2010/0019022 | A1 | 1/2010 | Ryan |
| 2010/0111453 | A1 | 5/2010 | Dierl |
| 2010/0147724 | A1 | 6/2010 | Mitra-Shah |
| 2010/0172604 | A1 | 7/2010 | Andersson |
| 2010/0226598 | A1 | 9/2010 | Stoeppelmann |
| 2010/0230303 | A1 | 9/2010 | Buse |
| 2010/0230411 | A9 | 9/2010 | Sierra-Gomez |
| 2010/0278454 | A1 | 11/2010 | Huffer |
| 2010/0303391 | A9 | 12/2010 | Cole |
| 2011/0049158 | A1 | 3/2011 | Bouthiette |
| 2011/0127319 | A1 | 6/2011 | Golden |
| 2011/0132976 | A1 | 6/2011 | Drenowski |
| 2011/0147443 | A1 | 6/2011 | Igo |
| 2011/0204056 | A1 | 8/2011 | Veternik et al. |
| 2011/0253718 | A1 | 10/2011 | Sierra-Gomez |
| 2012/0125932 | A1 | 5/2012 | Sierra-Gomez |
| 2012/0128835 | A1 | 5/2012 | Lyzenga |
| 2012/0177307 | A1 | 7/2012 | Duan |
| 2013/0004626 | A1 | 1/2013 | Renders et al. |
| 2013/0011527 | A1 | 1/2013 | Renders |
| 2013/0064477 | A1 | 3/2013 | Vogt |
| 2013/0064934 | A1 | 3/2013 | Vogt |
| 2013/0114918 | A1 | 5/2013 | Lyzenga |
| 2013/0121623 | A1 | 5/2013 | Lyzenga |
| 2013/0121624 | A1 | 5/2013 | Lyzenga |
| 2013/0270268 | A1 | 10/2013 | Lyzenga |
| 2014/0185965 | A1 | 7/2014 | Lyzenga |
| 2014/0270597 | A1 | 9/2014 | Friedman |
| 2015/0016756 | A1 | 1/2015 | Down |
| 2015/0021219 | A1 | 1/2015 | SeyfferthDeOliveira |

FOREIGN PATENT DOCUMENTS

| | | | | |
|---|---|---|---|---|
| BR | 62020307 | | 4/2003 | |
| BR | 68046367 | | 10/2009 | |
| CN | 1224396 | A | 7/1999 | |
| CN | 1781819 | A | 6/2006 | |
| DE | 1848870 | | 3/1962 | |
| DE | 3700988 | A1 | 7/1988 | |
| DE | 3835721 | A1 | 5/1990 | |
| DE | 9003401 | | 5/1990 | |
| DE | 9005297 | | 8/1990 | |
| DE | 9014065 | | 2/1991 | |
| DE | 4134567 | | 1/1993 | |
| DE | 424 423 | | 6/1994 | |
| DE | 19738411 | | 3/1999 | |
| DE | 19822328 | A1 | 11/1999 | |
| DE | 202004012301 | | 12/2004 | |
| DE | 20122333 | | 3/2005 | |
| DE | 202007005487 | | 6/2007 | |
| DE | 102007030267 | A1 | 1/2009 | |
| DE | 10 2010 019 867 | A1 * | 9/2011 | ..... B65D 83/08 |
| DE | 102010019867 | A1 | 9/2011 | |
| EP | 0085289 | | 8/1983 | |
| EP | 0307924 | A2 | 3/1989 | |
| EP | 0388310 | | 9/1990 | |
| EP | 408831 | A1 | 1/1991 | |
| EP | 0447636 | | 9/1991 | |
| EP | 0474981 | | 3/1992 | |
| EP | 0488967 | | 6/1992 | |
| EP | 0546369 | | 6/1993 | |
| EP | 0608909 | | 8/1994 | |
| EP | 0613824 | | 9/1994 | |
| EP | 0629561 | A2 | 12/1994 | |
| EP | 0661154 | | 7/1995 | |
| EP | 0669204 | B2 | 8/1995 | |
| EP | 0744357 | | 11/1996 | |
| EP | 0752375 | | 1/1997 | |
| EP | 0758993 | | 2/1997 | |
| EP | 0796208 | | 9/1997 | |
| EP | 0905048 | A | 3/1999 | |
| EP | 1046594 | | 10/2000 | |
| EP | 1056066 | | 11/2000 | |
| EP | 1086906 | A2 | 3/2001 | |
| EP | 1136379 | | 9/2001 | |
| EP | 1288139 | | 3/2003 | |
| EP | 1318081 | A1 | 6/2003 | |
| EP | 1350741 | | 10/2003 | |
| EP | 1375380 | A1 | 1/2004 | |
| EP | 1382543 | A2 | 1/2004 | |
| EP | 1437311 | A1 | 7/2004 | |
| EP | 1449789 | A1 | 8/2004 | |
| EP | 1457424 | | 9/2004 | |
| EP | 1468936 | | 10/2004 | |
| EP | 1477425 | A1 | 11/2004 | |
| EP | 1488936 | | 12/2004 | |
| EP | 1608567 | | 12/2005 | |
| EP | 1609737 | | 12/2005 | |
| EP | 1619137 | A1 | 1/2006 | |
| EP | 1637472 | A1 | 3/2006 | |
| EP | 1712468 | | 10/2006 | |
| EP | 1712488 | A1 | 10/2006 | |
| EP | 1755980 | | 2/2007 | |
| EP | 1760006 | A1 | 3/2007 | |
| EP | 1770025 | | 4/2007 | |
| EP | 1846306 | | 10/2007 | |
| EP | 1858776 | | 11/2007 | |
| EP | 1873082 | A1 | 1/2008 | |
| EP | 1908696 | | 4/2008 | |
| EP | 1939107 | | 7/2008 | |
| EP | 1975081 | A1 | 10/2008 | |
| EP | 2033910 | | 3/2009 | |
| EP | 2189506 | | 5/2010 | |
| FR | 1327914 | A | 5/1963 | |
| FR | 2674509 | | 10/1992 | |
| FR | 2693988 | | 1/1994 | |
| FR | 2766794 | | 2/1999 | |
| FR | 2783512 | | 3/2000 | |
| GB | 1107200 | | 3/1968 | |
| GB | 2171077 | | 8/1986 | |
| GB | 2266513 | | 11/1993 | |
| GB | 2276095 | A | 9/1994 | |
| GB | 2335652 | A | 9/1999 | |
| GB | 2339187 | A | 1/2000 | |
| JP | 57163658 | | 10/1982 | |
| JP | S5822411 | B2 | 5/1983 | |
| JP | 6080405 | | 5/1985 | |
| JP | 62171479 | | 10/1987 | |
| JP | 63022370 | | 1/1988 | |
| JP | 01167084 | A | 6/1989 | |
| JP | 01167084 | A * | 6/1989 | ..... B65D 83/08 |
| JP | 01226579 | A * | 9/1989 | ..... B65D 83/08 |
| JP | 01226579 | A | 9/1989 | |
| JP | 01267182 | A | 10/1989 | |
| JP | 01267182 | A * | 10/1989 | ..... B65D 83/08 |
| JP | H11343468 | | 12/1990 | |
| JP | 0581083 | | 11/1993 | |
| JP | 09142551 | A * | 6/1997 | ..... B65D 83/08 |
| JP | 09142551 | A | 6/1997 | |
| JP | 9150872 | | 6/1997 | |
| JP | H09156677 | A | 6/1997 | |
| JP | 10059441 | | 3/1998 | |
| JP | 10129685 | | 5/1998 | |
| JP | H10152179 | A | 9/1998 | |
| JP | 10120016 | | 12/1998 | |

(56) References Cited

FOREIGN PATENT DOCUMENTS

| | | | |
|---|---|---|---|
| JP | 11198977 | | 7/1999 |
| JP | 2000335542 | A | 12/2000 |
| JP | 2001114357 | | 4/2001 |
| JP | 2001301807 | | 10/2001 |
| JP | 2002002805 | A | 1/2002 |
| JP | 2002104550 | A | 4/2002 |
| JP | 200326224 | | 1/2003 |
| JP | 2003072774 | | 3/2003 |
| JP | 2003137314 | | 5/2003 |
| JP | 2005015015 | | 1/2005 |
| JP | 200602767 | | 2/2006 |
| JP | 2006062712 | | 3/2006 |
| JP | 2006137445 | A | 6/2006 |
| JP | 2007045434 | | 2/2007 |
| JP | 2009166870 | | 7/2009 |
| WO | 8606350 | | 11/1986 |
| WO | 9104920 | | 4/1991 |
| WO | 9411270 | A1 | 5/1994 |
| WO | 9532902 | | 12/1995 |
| WO | 9725200 | | 7/1997 |
| WO | 0064755 | | 11/2000 |
| WO | 0140073 | A1 | 6/2001 |
| WO | 02064365 | A1 | 8/2002 |
| WO | 02066341 | | 8/2002 |
| WO | 03013976 | A1 | 2/2003 |
| WO | 03035504 | | 5/2003 |
| WO | 03037727 | | 5/2003 |
| WO | 03059776 | A1 | 7/2003 |
| WO | 2004087527 | A1 | 10/2004 |
| WO | 2005054079 | | 6/2005 |
| WO | 2005056420 | | 6/2005 |
| WO | 2005110042 | | 11/2005 |
| WO | 2005110865 | | 11/2005 |
| WO | 2005110876 | | 11/2005 |
| WO | 2005110885 | A2 | 11/2005 |
| WO | 2005120989 | | 12/2005 |
| WO | 2005123535 | A1 | 12/2005 |
| WO | 2006055128 | A2 | 5/2006 |
| WO | 2006080405 | | 8/2006 |
| WO | 2006108614 | | 10/2006 |
| WO | 2007079071 | A1 | 7/2007 |
| WO | 2007090419 | | 8/2007 |
| WO | 2008051813 | | 5/2008 |
| WO | 2008062159 | A1 | 5/2008 |
| WO | 2008074060 | | 6/2008 |
| WO | 2008108969 | | 9/2008 |
| WO | 2008115693 | A1 | 9/2008 |
| WO | 2008122961 | | 10/2008 |
| WO | 2008146142 | | 12/2008 |
| WO | 2009065120 | | 5/2009 |
| WO | 2009111153 | | 9/2009 |
| WO | 2010002834 | | 1/2010 |
| WO | 2010046623 | | 4/2010 |
| WO | 2010080810 | | 7/2010 |
| WO | 2010084336 | A1 | 7/2010 |
| WO | 2010088492 | A1 | 8/2010 |
| WO | 2010114879 | A1 | 10/2010 |
| WO | 2010149996 | A1 | 12/2010 |
| WO | 2011004156 | A2 | 1/2011 |
| WO | 2011121337 | A2 | 10/2011 |
| WO | 2012098412 | | 7/2012 |

OTHER PUBLICATIONS

'Elite Edam Cheese', Mintel gnpd, Dec. 3, 2001, Mintel Publishing, 2 pages.

'Margin.' Merriam-Webster Online Dictionary. 2010. Merriam-Webster [online], retrieved on May 6, 2010, Retrieved from the internet:URL: http://www.merriam-webster.com/dictionary/margin, 3 pages.

'New Easy Peel Cheese Packaging', Mintel gnpd, Aug. 10, 2001, Mintel Publishing.

'New on the Shelf-Product Instructions and Packaging Trends', Circle Reader Service Card No. 93, Aug. 1998, Baking & Snack.

'Soft Bread Sticks', Mintel gnpd, Mar. 20, 1998, Mintel Publishing, 1 page.

"Wall's Bacon" A Sizzling Success Story and The Grocer: "When sealed delivers", the second page of which bears a date of Aug. 21, 1999.

Defendants' Answer, Affirmative Defenses, and Counterclaims Responsive to Complaint, dated Apr. 5, 2012, 25 pages.

Defendants' Final Invalidity Contentions—Exhibit A-1, dated Sep. 27, 2013, 55 pages.

Defendants' Final Invalidity Contentions—Exhibit A-2, dated Sep. 27, 2013, 35 pages.

Defendants' Final Invalidity Contentions—Exhibit A-3, dated Sep. 27, 2013, 34 pages.

Defendants' Final Invalidity Contentions—Exhibit A-4, dated Sep. 27, 2013, 35 pages.

Defendants' Final Invalidity Contentions—Exhibit B-1, dated Sep. 27, 2013, 135 pages.

Defendants' Final Invalidity Contentions—Exhibit B-2, dated Sep. 27, 2013, 64 pages.

Defendants' Final Invalidity Contentions—Exhibit B-3, dated Sep. 27, 2013, 140 pages.

Defendants' Final Invalidity Contentions—Exhibit B-4, dated Sep. 27, 2013, 273 pages.

Defendants' Final Invalidity Contentions—Exhibit B-5, dated Sep. 27, 2013, 146 pages.

Defendants' Final Invalidity Contentions—Exhibit B-6, dated Sep. 27, 2013, 226 pages.

Defendants' Final Invalidity Contentions Pursuant to LPR 3.1, dated Sep. 27, 2013, 22 pages.

Defendants' Final Unenforceability Contentions Pursuant to LPR 3.1, dated Sep. 27, 2013, 14 pages.

Defendants' Initial Non-Infringement Contentions Pursuant to LPR 2.3(a), dated May 17, 2013, 7 pages.

Defendants' Invalidity Contentions—Exhibit A-1, dated May 17, 2013, 55 pages.

Defendants' Invalidity Contentions—Exhibit A-2, dated May 17, 2013, 35 pages.

Defendants' Invalidity Contentions—Exhibit A-3, dated May 17, 2013, 34 pages.

Defendants' Invalidity Contentions—Exhibit A-4, dated May 17, 2013, 35 pages.

Defendants' invalidity Contentions—Exhibit A-5, dated May 17, 2013, 39 pages.

Defendants' Invalidity Contentions Pursuant to LPR 2.3, dated May 17, 2013, 23 pages.

Defendants' LPR 2.3 Initial Non-Infringement Contentions Exhibit A, dated May 17, 2013, 39 pages.

Defendants' Unenforceability Contentions Pursuant to LPR 2.3, dated May 17, 2013, 13 pages.

English Transiation of JP H09-158677 published on Jun. 17, 1997, 2 pages.

English Translation of Japanese Official Notice of Rejection mailed on Feb. 14, 2012 in JP Application No. 2009-172352, 3 pages.

English Translation of JP 1998-152179 (H10-152179 A), published on Sep. 6, 1998, 6 pages.

English Translation of JP 2001-114357 published on Apr. 24, 2001, 8 pages.

English Translation of JP 2003-26224 published on Jan. 29, 2003, 13 pages.

English Translation of JP H09-156677 published Jun. 17, 1995; 8 pages.

English Translation of JP Official Notice of Rejection mailed on Jan. 29, 2013 in JP Appl. No. 2008-087152 citing JPH0581083, 5 pages.

European Packaging Pack Report, NR. May 5, 2001 and partial translation thereof, 6 pages.

European Search Report, EP10305289 citing DE1848870U, 3 pages.

European Search Report 06118142.6 dated May 3, 2007, citing DE90140656, 10 pages.

Fuji Packaging GmbH Fachpack brochure, Oct. 11-12, 2001; 2 pages.

Giant Baby Wipes package, item No. 80203-91, resealable package having die cut-out portions (tabs) which remain affixed to the top of the package after label is withdrawn from the top, whereby tamper

(56) References Cited

OTHER PUBLICATIONS evidence is indicated by a misalignment of the die cut-out portions with the holes formed in the label.
Global Brands' LPR 2.5 Initial Response to Defendants' Initial Invalidity Contentions Chart Ex. A-1, dated May 31, 2013, 30 pages.
Global Brands' LPR 2.5 Initial Response to Defendants' Initial Invalidity Contentions Chart Ex. A-2, dated May 31, 2013, 20 pages.
Global Brands' LPR 2.5 Initial Response to Defendants' Initial Invalidity Contentions Chart Ex. A-3, dated May 31, 2013, 21 pages.
Global Brands' LPR 2.5 Initial Response to Defendants' Initial Invalidity Contentions Chart Ex. A-5, dated May 31, 2013, 14 pages.
Global Brands LPR 2.5 Initial Response to Defendants' Initial Invalidity Contentions Chart Ex. A-4, dated May 31, 2013, 17 pages.
International Search Report, PCT/EP2011/054250 dated Jun. 28, 2011, 3 pages.
Machine translation of claim for BR 5500885-2 from Googletranslate.com; 1 page.
Machine translation of claim for BR 6202030-7 from Googletranslate.com; 1 page.
Machine translation of claim for BR 6804636-7 from Googletranslate.com; 1 page.
Machine translation of DE 202007005487, published Jun. 14, 2007, provided by Espacenet, 3 pages.
Machine translation of DE9014065, published Mar. 19, 2009, provided by Espacenet, 9 pages.
Machinery Update, Mar./Apr. 2002, pp. 56-62.
Machinery Update, Sep./Oct. 2001, pp. 46-47.
Opposition to EP1679269 filed by Awapatent AB, Heisingborg, Sweden. May 2, 2012.
Opposition to EP1679269 filed by Bahlse GmbH and Co. KG, Apr. 30, 2012.
Partial European Search Report for Appl. No. EP11155570 dated Jun. 12, 2011, citing DE9003401 and DE9005297, 9 pages.
Plaintiff's Initial Response to Defendant's Initial Invalidity Contentions, dated May 31, 2013, 20 pages.
Plaintiffs Answer to Counterclaims of Defendant, dated Apr. 26, 2013, 20 pages.
Plaintiffs Complaint for Patent Infringement, dated Jan. 16, 2013, 7 pages.
Reclosure system lengthens food life, Packaging News PPMA Preview, Sep. 2001, 4 pages.
Reseal-It. Web page Internet print out accessed Mar. 14, 2005; 19 pages.
European Search Report for EP 10305091 dated Apr. 30, 2010.
International Search Report for PCT/EP2011/051008 dated Apr. 13, 2011.
Machine translation of CN 1781819A published Jun. 7, 2006 from google.com/patents; 13 pages, accessed Jun. 5, 2014.
English Translation of Japanese Unexamined Application Publication No. H9-156677, published Jul. 17, 1997; 6 pages.
Kellogg's Reply Claim Construction Brief, dated Jan. 24, 2014, 19 pages.
Kellogg's Opening Claim Construction Brief, dated Dec. 13, 2013, 30 pages.
Defendants' Supplemental Memorandum of Law Regarding Additional Claim Construction Authority Requested by the Court, dated Feb. 28, 2014, 13 pages.
Kellogg's Response to Plaintiff's Surreply Claim Construction Brief Pursuant to Docket No. 98, dated Feb. 28, 2014, 9 pages.
Plaintiff Intercontinental Great Brands LLC's Submission of Authority Pursuant to Docket No. 98, dated Feb. 28, 2014, 11 pages.
Plaintiff Intercontinental Great Brands LLC's Responsive Claim Construction Brief Pursuant to LPR 4.2, dated Feb. 10, 2014, 27 pages.
U.S. District Court for the Northern District of Illinois, Eastern Division Memorandum Opinion and Order, dated Sep. 22, 2014, 12 pages.
Plaintiff Intercontinental Great Brands LLC\s Surreply Claim Construction Brief Pursuant to Docket No. 98, dated Feb. 21, 2014, 6 pages.
Additional Exhibits from Declaration of James Lukas Jr. filed Mar. 26, 2015, 73 pages.
Declaration of James J. Lukas, Jr. in Support of Defendants' Motion for Summary Judgment with Exhibits, Part 1 dated Mar. 23, 2015, 277 pages.
Declaration of James J. Lukas, Jr. in Support of Defendants' Opposition to Plaintiff's Motions for Summary Judgment with Exhibits (redacted), dated May 28, 2015, 228 pages.
Declaration of Katie Crosby Lehmann in Support of Plaintiff's Consolidated Memorandum of Law in Support of Plaintiff's Cross-Motion for Summary Judgment with Exhibits Part 1 (redacted), dated May 8, 2015, 400 pages.
Declaration of Katie Crosby Lehmann in Support of Plaintiff's Reply in Support of its Motions for Summary Judgment and Exhibit (unsealed), dated Jun. 10, 2015, 8 pages.
Defendants' Consolidated Memorandum in Support of Motion for Summary Judgment (redacted) with Exhibits A-G, dated Mar. 23, 2015, 166 pages.
Defendants' Consolidated Reply in Support of Defendants' Motion for Summary Judgment with Exhibits, dated May 28, 2015, 36 pages.
Defendants' Local Rule 56.1 Statement of Material Facts in Support of Motion for Summary Judgment (redacted), dated Mar. 23, 2015, 75 pages.
Defendants' LR 56.1 (b) (3) (C) Statement of Additional Material Facts in Support of Their Opposition to Plaintiff's Motions for Summary Judgment (redacted), dated May 28, 2015, 30 pages.
Defendants' Memorandum in Support of Motion for Summary Judgment of Non-Infringement and Their Motion for Summary Judgment of Invalidity Under 35 U.S.C. 102 and/or 103, dated Mar. 26, 2015, 60 pages.
Defendants' Memorandum in Support of Their Motion to Compel Discovery, dated Oct. 13, 2014, 13 pages.
Defendants' Motion for Summary Judgment of Non-Infringement and Motion for Summary Judgment of Invalidity Under 35 U.S.C. 102 And/Or 103, dated Mar. 23, 2015, 4 pages.
Defendants' Motion to Compel Discovery, dated Oct. 13, 2014, 3 pages.
Defendants' Response to Plaintiff's Local Rule 56.1 Statement of Material Facts in Support of Plaintiff's Motions for Summary Judgment, dated May 28, 2015, 108 pages.
Exhibits, part 2, to Declaration of James J. Lukas, Jr. in Support of Defendants' Motion for Summary Judgment, dated Mar. 23, 2015 125 pages.
Exhibits, part 2, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 3, to Declaration of James J. Lukas, Jr. in Support of Defendants' Motion for Summary Judgment, dated Mar. 23, 2015, 125 pages.
Exhibits, part 3, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 4, to Declaration of James J. Lukas, Jr. in Support of Defendants' Motion for Summary Judgment with Exhibits, dated Mar. 23, 2015, 28 pages.
Exhibits, part 4, to Declaration of Katie Crosby Lehmann in Support of Plaintiff's Consolidated Memorandum of Law in Support of Plaintiff's Cross-Motion for Summary Judgment (redacted), dated May 8, 2015, 100 pages.
Exhibits, part 5, to Declaration of Katie Crosby Lehmann in Support of Plaintiff's Consolidated Memorandum of Law in Support of Plaintiff's Cross-Motion for Summary Judgment (redacted), dated May 8, 2015, 200 pages.
Exhibits, part 6, to Declaration of Katie Crosby Lehmann in Support of Plaintiff's Consolidated Memorandum of Law in Support of Plaintiff's Cross-Motion for Summary Judgment (redacted), dated May 8, 2015, 300 pages.
Exhibits, part 7, to Declaration of Katie Crosby Lehmann in Support of Plaintiff's Consolidated Memorandum of Law in Support of Plaintiff's Cross-Motion for Summary Judgment (redacted), dated May 8, 2015, 136 pages.

(56) References Cited

OTHER PUBLICATIONS

Exhibits from Defendants' Memorandum in Support of Their Motion to Compel Discovery, dated Oct. 13, 2014, 68 pages.
Exhibits from Plaintiff's Memorandum of Law in Opposition to Defendants' Motion to Compel Discovery, Oct. 15, 2014, 78 pages.
Plaintiff's Consolidated Memorandum of Law in Support of Plaintiff's Cross-Motion for Summary Judgment, dated May 8, 2015, 54 pages.
Plaintiff's Cross-Motion for Summary Judgment, dated Apr. 27, 2015, 4 pages.
Plaintiff's LR 56.1(a) Response to Defendants' Statement of Additional Material Facts in Support of Their Opposition to Plaintiff's Motion for Summary Judgment (redacted), dated Jun. 10, 2015, 39 pages.
Plaintiff's Memorandum of Law in Opposition to Defendants' Motion to Compel Discovery, Oct. 15, 2014, 12 pages.
Plaintiff's Reply in Support of its Motions for Summary Judgment, dated Jun. 1, 2015, 19 pages.
Machine Translation of EP 1449789 description. Translated on Jun. 13, 2015, 18 pages.
Defendant's Local Rule 56.1 Statement of Material Facts in Support of Motion for Summary Judgment, dated Mar. 23, 2015, 75 pages.
English Translation of JP2006137445 filed by Shimomura, published Jun. 1, 2006, translation provided by the USPTO in U.S. Appl. No. 13/698,567.
U.S. District Court for the Northern District of Illinois, Eastern Division, Memorandum Opinion and Order, dated Aug. 3, 2015, 37 pages.
English Translation of JP2002-002805 filed by Onuma, published Sep. 1, 2012, translation provided by the USPTO in U.S. Appl. No. 11/193,614.

* cited by examiner

RESEALABLE PACKAGING FOR FOOD PRODUCTS AND METHOD OF MANUFACTURING

CROSS REFERENCE TO RELATED APPLICATIONS

This application is a national phase application of International Application No. PCT/EP2011/051008, filed Jan. 26, 2011, designating the United States and claiming priority to European Patent Application No. 10305091.0, filed Jan. 26, 2010, which is incorporated by reference herein in its entirety.

FIELD OF INVENTION

The present disclosure relates to a packaging for food products, such as crackers, biscuits, cookies, confectionery, chocolate like or other snacks, provided with a resealable closure. More particularly, the disclosure relates to such packaging comprising:

a flexible container formed by a flexible film, said container having a top face, a bottom face and side faces, a container aperture extending at least within the top face and being wide enough for withdrawing a food product, a closure flap made of a flexible material, said closure flap extending longitudinally from a base portion designed to remain bonded to the container to a gripping member, and provided therebetween with a movable portion covered of repositionable adhesive which is peelable from a closed position in which said movable portion covers the container aperture and adheres to a peripheral area thereof.

BACKGROUND OF THE INVENTION

There is consumer demand for food products packaging having a closure which enables one to withdraw only a portion of the products and to reclose the packaging in order to preserve the freshness of the remaining products therein, during a period which may vary from hours to few days. In particular with dry food products like crackers, the ambient humidity may quickly alter their crispiness.

Further, inexpensive packaging, which generates little waste, is desirable.

Packaging having resealable openings are known, notably from the document EP1086906 A2 which discloses in a second embodiment, a label which can be reset over a slit shaped opening formed by tearing off a portion of the wrapping film at the first opening.

However, improving the resealability of the packaging is of interest, notably regarding the facility for the user to reclose the container and regarding the tightness of the reclosed packaging. This is particularly desirable when a substantial portion of the food products have been withdrawn from the package.

SUMMARY OF THE INVENTION

With this object, the present invention proposes a resealable packaging for food products of the above-mentioned type, characterized in that it further comprises a stiffening band device made of a flexible material longer than the closure flap, said band device being bonded to the container through the top face and at least over two side faces and being arranged to cover at least the portions of the peripheral area comprised between the longitudinal sides of the closure flap and the sides of the container aperture, and in that said container aperture and said stiffening band device in the peripheral area of the aperture, are delimited by continuous cut out lines.

The stiffening band device creates an additional layer of material. This additional layer stiffens at least the major part of the flexible container on which the closure flap adheres. The fact that a stiffening band is bonded to the flexible film forming the container, by a layer of adhesive or possibly by a heat sealing bond, and not merely arranged against the inner side of the container, is supposed to be essential for obtaining the stiffening effect. The stiffening effect creates an area which remains more flat, and which is less subject to form waves or to crumple, even said area by the aperture is not made rigid. It should be noted that the fact of using a band device, that is to say one or several relatively thin elements, made of flexible material has advantages regarding the manufacturing and filling process of the packaging. This process still include steps quite similar to the process used for flexible container having no releasable closure.

The fact that the flexible container aperture and the stiffening band edge along said aperture are delimited by a continuous cut out line also appears important for improving the resealability of the closure flap, though one could think that a cut out line would be detrimental for the initial tightness of the container seal. Usually, the openings of that kind of packaging are defined by a weakened line or a dinked line in order to preserve the tightness of the container seal. Perforated lines are also used. However, these lines usually have to be torn off at the initial opening. Tearing of the flexible container along the aperture border creates permanent deformations like undulations or wrinkles, which may create small air passages when the closure flap is reset in the closed position.

The fact that the stiffening band device is longer than the closure flap and extends over two opposite side faces has also an advantageous effect on the seal between the closure flap and the flexible container after the initial opening. With this arrangement, the stiffness of the container is improved beyond the area of the closure flap in a direction corresponding to the direction of the force exerted by the consumer, either when he pulls the gripping member toward the base portion of the closure flap to open the container, or conversely when he pulls down the closure flap to the closed position. This configuration reduces the risk of creating large deformations in the top face. It appears important to stiffen the peripheral area of the aperture along the portions thereof which extend along the longitudinal direction of the closure flap, i.e. the portions between the longitudinal sides of the closure flap and the corresponding sides of the container aperture. The shorter sides of the container aperture may remain free of the stiffening band in some embodiments. However, the fact of stiffening the whole peripheral area seems to combine with the longitudinal extension of the stiffening band device to maintain a smooth profile over this whole peripheral area.

The fact that the stiffening band device extends on the side faces has the additional advantage of preserving the initial cross-sectional profile of the flexible container, even when most of the food products have been withdrawn and cannot support the peripheral area of the aperture. Thus, the resealable closure of the invention is also suitable for packaging food products in bulk within the container.

In preferred embodiments of the invention, one or many of the following features can be used.

The flexible film forming the container has an inner and an outer side, the stiffening band device being bonded to the inner side of the flexible film. This appears quite advantageous for the esthetical aspect of the packaging without being really detrimental to the manufacturing and filling process.

The flexible container extends along a longitudinal axis between two opposite side faces on which the flexible film is sealed, and the closure flap and the stiffening band device coaxially extend along a transversal direction with respect to the longitudinal axis. This configuration limits the length needed for the stiffening band device and makes it easier to achieve the supporting function provided by said band device. It also prevents the stiffening band device from interfering with the sealing seams or folds of the flexible film at the longitudinal ends.

The stiffening band device is also bonded over at least a portion of the bottom face. This disposition further stiffens the flexible container in the extension direction of the closure flap and provides a foot like member to the side face portions of the stiffening band device.

The flexible container has a sealing seam extending through the bottom face, and the stiffening band device is extended up to ends which are bonded to the bottom face at a distance from the sealing seam. This in order to prevent any interference of the stiffening band device ends with the longitudinal sealing during the manufacturing process.

A container panel cut from the container flexible film adheres to the movable portion of the closure flap, and a stiffening panel made of a flexible material is bonded to the container panel, said container and stiffening panels being arranged to fit within the container and stiffening band apertures in a closed position. Said panels create two additional layers on a major part of the movable portion of the closure flap. The stiffening panel also forms an inner side of the closure flap which is not sticky.

The flexible material forming the stiffening band device is a plastic film having a thickness comprised within a range of 30 to 120 micrometers, and preferably about 50 micrometers.

The flexible material forming the stiffening band device has a thickness comprised between 100% to 150% of the thickness of the flexible film forming the container, and preferably about 120% of said thickness. Such a stiffening band device is particularly thin and remains flexible. However, tests show that this thickness provides a sufficient stiffness to the peripheral area of the aperture and in the extension direction of the closure flap to improve substantially the resealability. Such a thickness is particularly advantageous regarding the manufacturing and filling process, and does not prevent the stacked food products from sliding in front of the aperture.

The stiffening band device is covered with a repositionable adhesive, which bonds said band device to the inner side of the container. The stiffening band device is not peeled off the flexible container, and the use of a repositionable adhesive, notably the same adhesive as used for the closure flap, simplifies the manufacturing process.

The stiffening band device is transparent. With this disposition the external aspect of the packaging is absolutely not modified since the stiffening band device can not create a darker area through the flexible film.

The stiffening band device has a portion of larger width which is arranged at least partially over the inner side of the top face. This disposition improves the stiffness of the flexible packaging in any direction in the area where the consumer may exercise a downward pressure when he recloses the packaging.

The stiffening band device has longitudinal straight edges. That saves flexible material needed by significantly reducing the scraps. The width of the stiffening band device is slightly larger than the closure flap, for example, larger of five millimeters on each side, and can guarantee that the stiffening band covers the whole surface covered by the closure flap, even if a misalignment may occur during the manufacturing process.

The stiffening band device comprises a single band, said band being at least as substantially wide as the closure flap and having a band aperture arranged to correspond to the container aperture. The container and the band apertures are delimited by a continuous annular cut out. With an annular continuous cut out line, no edge of a flexible container panel or stiffening band panel remains attached along the base portion of the closure flap. This disposition prevents to form a resilient hinge in the area of the possible attachment line. Only the line of the closure flap delimitating the base portion from the movable portion thereof forms a flexible hinge. Consequently, the pull down of the closure flap is facilitated.

The stiffening band device comprises at least two band elements arranged on each side of the container aperture at a distance from each other, in order to save flexible material.

The flexible container contains a stack of flat food products, the width of the container aperture being greater than the thickness of five products and smaller than 60% of the total length of the stack. A width within that range offers a good compromise between the facility of withdrawing products and the tightness of the resealed packaging.

The container aperture extends through the top face and over an upper portion of the two side faces, said upper portions having a height smaller than one third of the total height of said side faces. Such an aperture width offers a good compromise between the resealability of the packaging and the convenience for withdrawing food products.

The invention relates also to a manufacturing method of said packaging. This method comprises the steps of:

providing a printed flexible film; then bonding a closure flap with repositionable adhesive;

bonding a stiffening band device made of flexible material, said closure flap and stiffening band device being arranged in predetermined positions with respect to a container aperture to be defined; and then cutting out simultaneously through the flexible film and through the flexible material of the stiffening band device possibly present, along a continuous line which defines the container aperture.

With these steps, which may be included in a usual process, a perfect correspondence of the container aperture with the stiffening band edges is guaranteed, even if some misalignment between said band(s) and the printed flexible film occurred.

Preferably, the closure flap is bonded to an outer side of the flexible film, and the stiffening band device is bonded to an inner side of said flexible film. Thus these elements can be bonded nearly at the same time, and the additional thickness is distributed on the both sides which is favourable for further processing the film.

Additionally, the cutting out is performed along an annular line, the portions cut off from the flexible film and from the flexible material forming the stiffening band device remaining attached to the closure flap.

BRIEF DESCRIPTION OF THE DRAWINGS

Further advantages and characteristic features will become apparent from the following description of some embodiments, given by way of example, with reference to the drawings, in which.

DETAILED DESCRIPTION OF EMBODIMENTS

The same numeral references are used in the figures to designate identical or similar elements.

Figure 1:
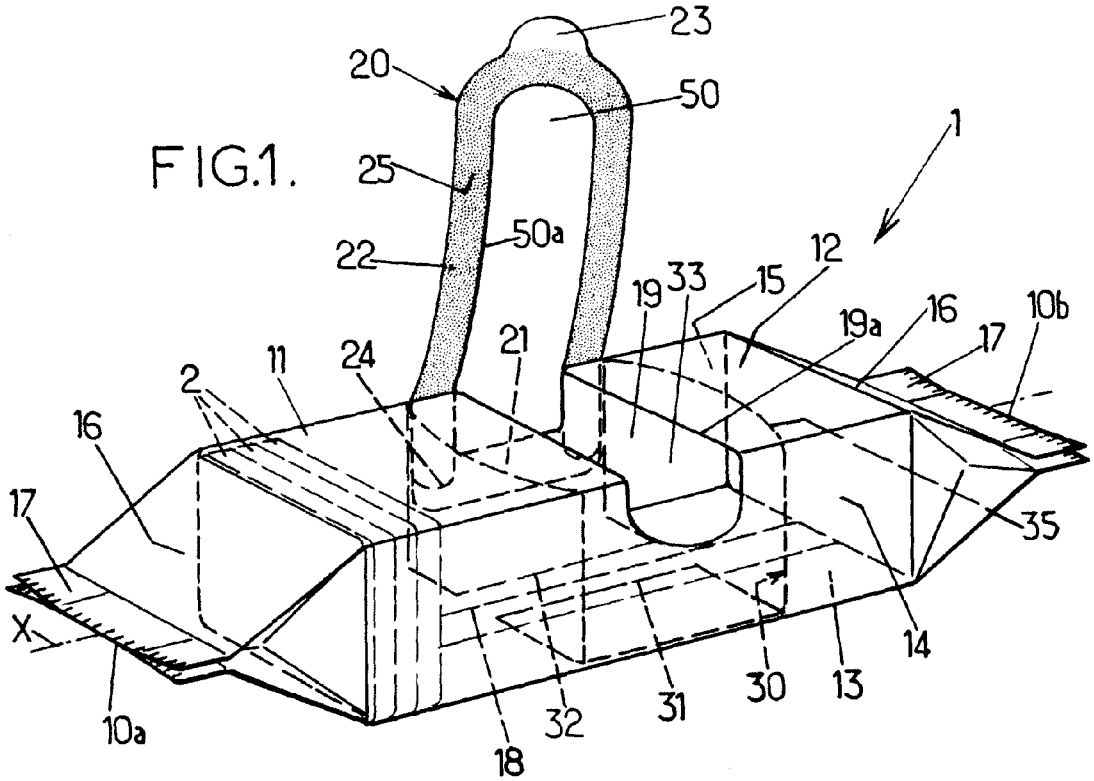
FIG. 1 is a schematic perspective view of a food packaging according to the invention having a closure flap in open position and a stiffening band device represented in dashed lines.

At FIG. 1, is represented a packaging 1 containing food products 2 schematically represented in dashed lines.

In this embodiment, the food products are crackers of generally rectangular shape which are arranged adjacent to each other to form a stack. The food products are not necessarily rectangular, they could be more or less round or polygonal, notably octagonal with a shape corresponding to a rectangle with the corners cut off. The packaging is suitable for various kinds of dry food products, like biscuits, cookies, slices of bread. The food products are not necessary arranged to form a stack. The packaging is also suitable for smaller products in bulk, like any kind of crackers or sweets, as it will appear from the description below.

The packaging 1 comprises a container 10 made of flexible film 11 so that the container 10 is flexible itself.

In the embodiment container 10 has an elongated shape extending along a longitudinal axis X between two longitudinal ends (10*a*, 10*b*). The container 10 presents a top face 12, a bottom face 13, and side faces. In the embodiment, the side faces comprise a front side face 14, a rear side face 15 and two opposite lateral faces 16 at the longitudinal ends (10*a*, 10*b*).

Figure 2:
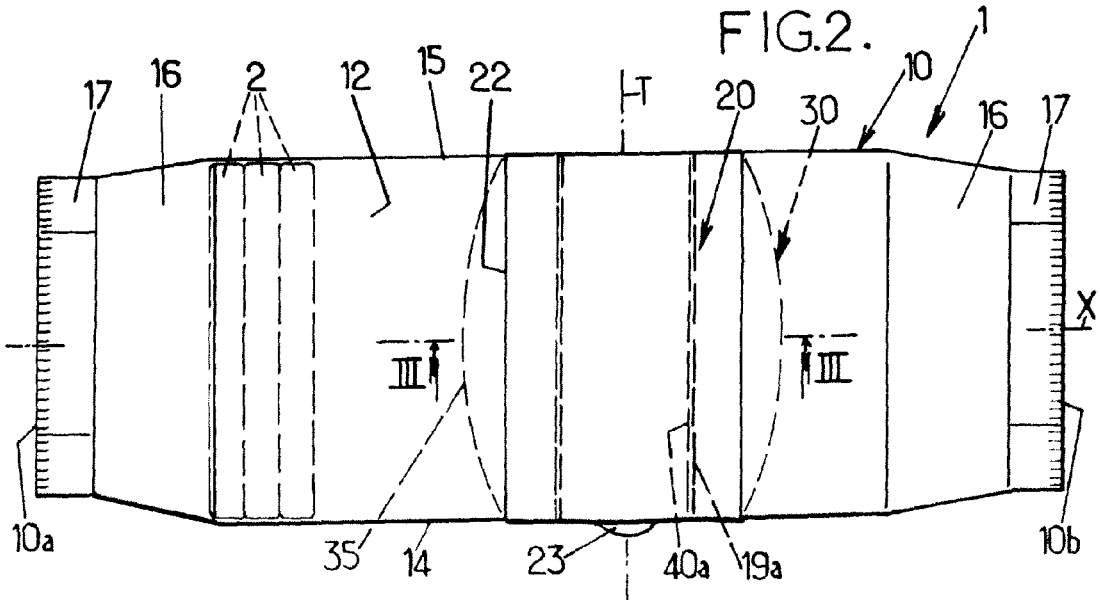
FIG. 2 is an elevation view of the packaging of the FIG. 1 in which the closure flap is in closed position.
Figure 4:
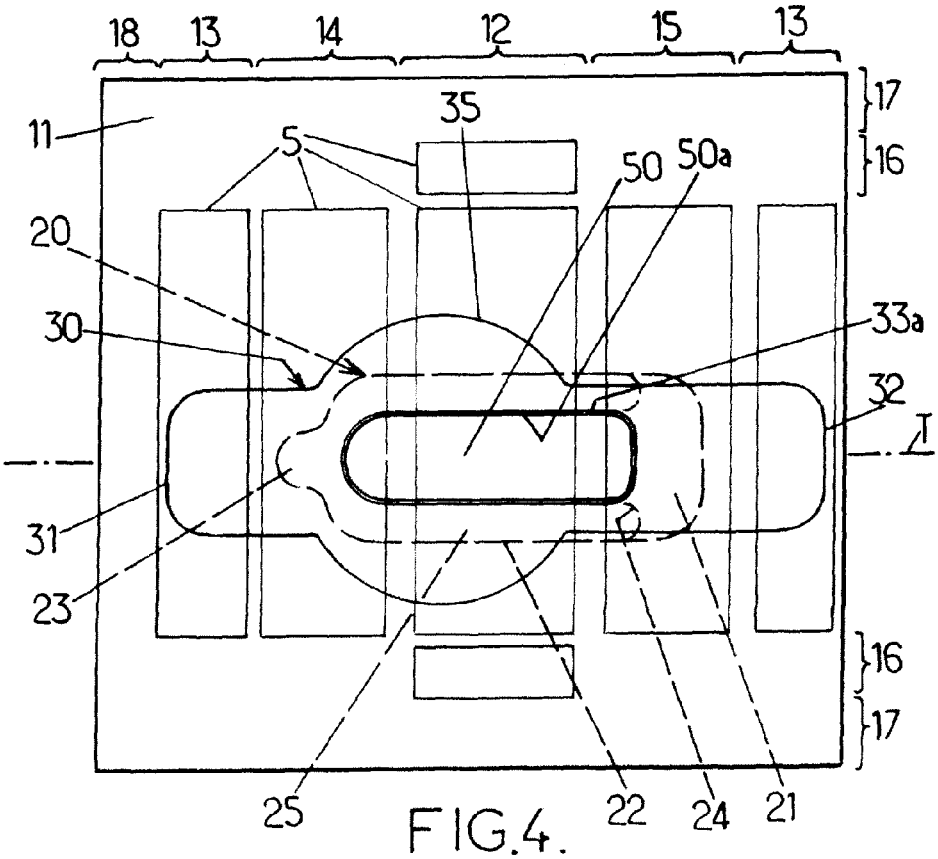
FIG. 4 is a view of the inner side of the packaging of FIG. 1 in a flat configuration with a first alternative embodiment of the stiffening band device represented in continuous lines.
Figure 5:
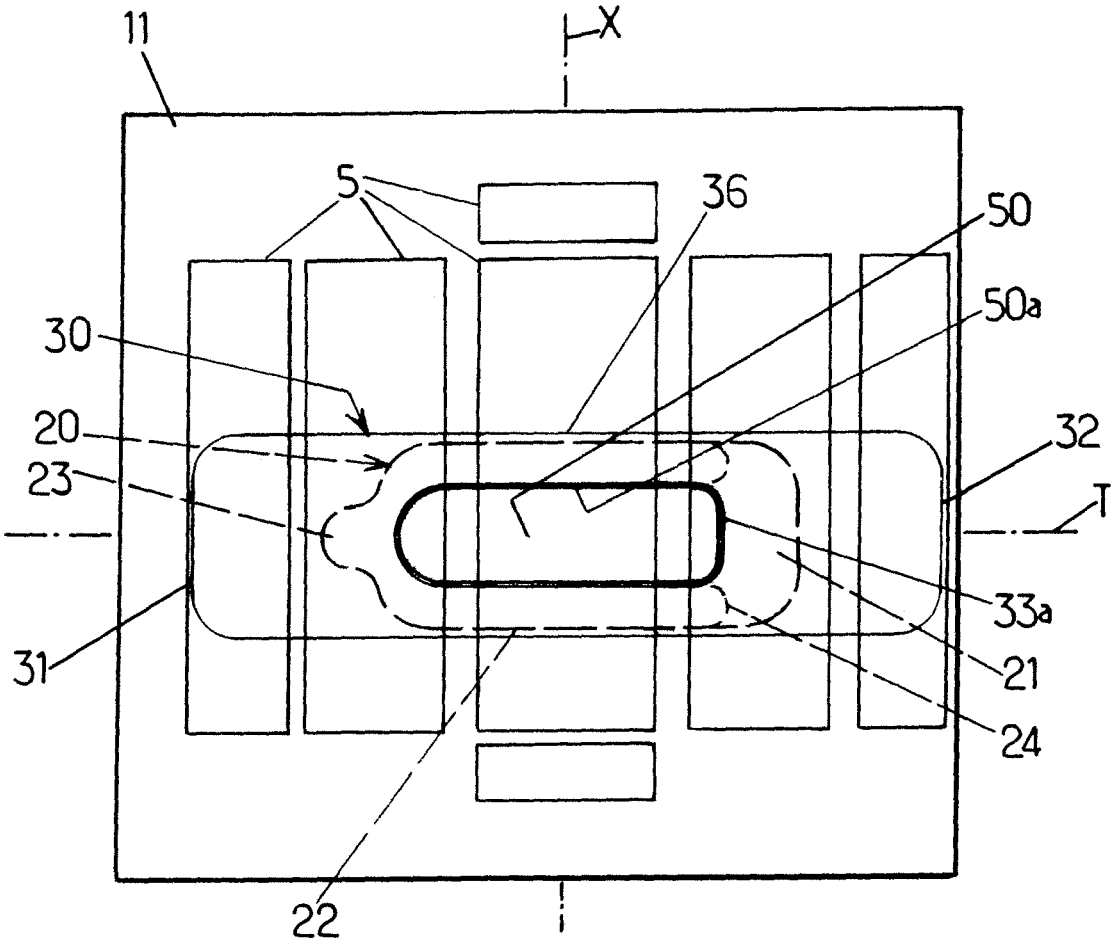
FIG. 5 is a similar view of the FIG. 4 with a second alternative embodiment of the stiffening band device.

The outside of the flexible container 10 is printed with decorative and information graphics, not represented on FIGS. 1 and 2 for sake of clarity, but schematically indicated on FIGS. 4 and 5 by rectangles 5. Each rectangle corresponds approximately to a face of the packaging, unless for the bottom face 13 for which the graphics are split in two rectangles.

The flexible container 10 is not, however, a parallelepiped. The lateral side faces 16 can present a pyramidal shape, like in the preferred embodiment, terminated by transversal sealing seams 17 made by a heat sealing bond. Additionally, the flexible container 10 does not necessarily wrap the stacked foods products in a tight manner. Consequently, the flexible container 10 may not have a cross section profile with rigid angles but a somewhat more rounded profile, possibly like that of the food product. In fact, in the embodiment represented, the flexible container 10 is also named a slug. It has no sharp edges, despite the straight lines used in the FIG. 1 for sake of clarity. In case of products in bulk, the flexible container 10 may further differ from a parallelepiped. The cross section profile is not necessary a rectangle, but could be any kind of polygon, even a triangle. In that case the top face is particularly narrow and the front and rear faces are not parallel. Further, the expression "side faces" must be interpreted as meaning the surfaces of the container 10 visible on an orthogonal side view, the top of bottom faces being the complementary surfaces.

The flexible film 11 is made of plastic, in particular made of polyester (PE) having a thickness about 40 micrometers in the preferred embodiments. However the film can be made of another material, by way of example made of polyester and polypropylene (PP) laminate and its thickness can vary substantially depending of the resistance and various properties needed for the food contained. The thickness can notably vary within a range of 30 to 90 micrometers.

To form a tubular body, the flexible film is sealed along a longitudinal sealing seam 18 partially visible in dashed line on FIG. 1, which extends through the bottom face 13 up to the end sealing seams 17. In the preferred embodiment, the longitudinal sealing seam is a hot sealing bond and extends through the middle of the bottom face 13.

The flexible film 11 is made of white plastic printed on the side corresponding to the outer of the container 10. However, the flexible film may not be totally opaque due to its low thickness.

The flexible container 10 has an aperture 19 designed to enable withdrawn of at least one product 2 there through. The container aperture 19 is located on the top face 12. In the preferred embodiment, the aperture 19 extends transversally through the top face 12 and upon an upper portion of the front and rear side faces (14, 15) in order to facilitate the withdrawn of food products.

It should be noted that the aperture is delimited by a continuous cut out line 19*a*, so that no portion of the flexible container 10 has to be torn at the first opening of the packaging, at least in the peripheral area of the aperture so that area is not subjected to permanent deformation of the flexible film. However, the cut line can include few indentations defining narrow strips, possibility with an end not cut, which extend toward the aperture centre to form integrity indicating means as described in document EP1975081 A1. Such narrow strips cannot create significant permanent deformation of the peripheral area.

As shown in FIGS. 4 and 5, the aperture has a generally rectangular shape indicated by the cut out line 19*a*, which extends along a transversal direction T with respect to the longitudinal axis X of the packaging. The longitudinal edges of the aperture 19 are straight, and its ends are more or less rounded.

The packaging 1 further comprises a closure flap 20 provided on the outer side of the flexible container 10. The closure flap 20 comprises a base portion 21, a movable portion 22 designed to cover the container aperture 19 and a peripheral area thereof in closed position, and gripping member 23 at the opposite longitudinal end of the base portion 21.

The closure flap is made of flexible material and preferably made of a plastic film. In the preferred embodiment, the flexible material is a transparent film of PP which has a thickness about 50 micrometers.

The closure flap 20 is covered with a repositionable adhesive, notably a pressure sensitive adhesive (PSA), except over the tab forming the gripping means 23. The layer of adhesive is uniform and thin like for a label.

The base portion 21 of the flap adheres to the rear side face 15 over a medium portion thereof situated below the end of the aperture 19. The base portion has to remain attached to the flexible container 10, at least during normal use. To that end, peeling stop cuts 24 are created through the base portion 21.

These stop cuts known per se can be replaced by other means like a layer of permanent adhesive or a hot sealing between the base portion 21 and the flexible container 10.

The movable portion 22 has to be wider than the container aperture 19 so that a margin 25 covered with the repositionable adhesive, indicated by dots on FIG. 1, covers a peripheral area of the aperture 19. The peripheral area can be covered over a portion by the base portion 21 to complete the U-shaped margin 25 of the movable portion 22. However, it is important, at least before the first opening, that the closure flap 20 uniformly and tightly covers the peripheral area of the container aperture 19, since this aperture is delimited by a cut out line through the container 10. By way of example, a margin of 15 mm provides a sufficient seal.

It is highly preferable that the central area of the movable portion 22, which corresponds in shape and position to the aperture 19 in the closed position, is not adhesive. Many possibilities can prevent the central area to be sticky, like keeping the central area free of adhesive. However, it is more advantageous to cover the central area with one, and preferably two panels as it will appear below.

Figure 6:
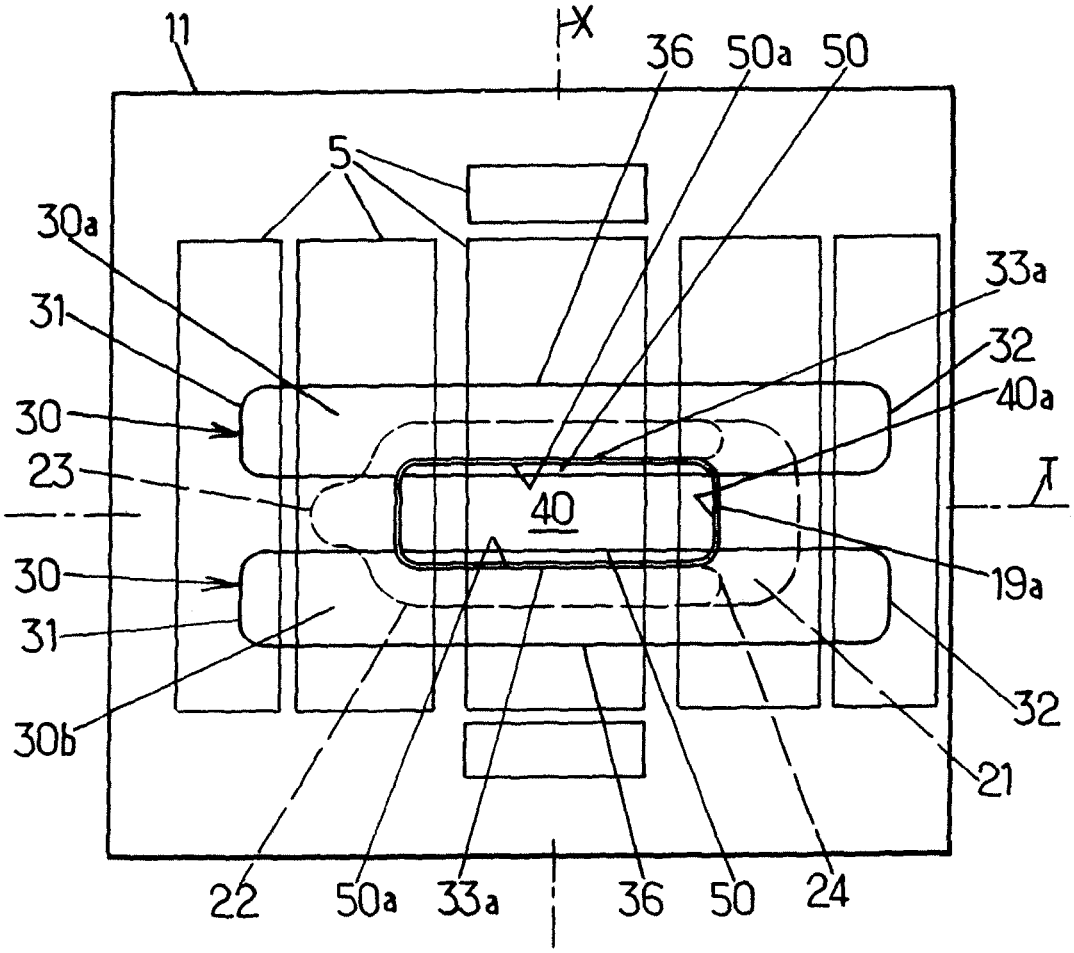
FIG. 6 is a similar view of the FIG. 4 with a third alternative embodiment of the stiffening band device.

According to the invention, a stiffening band device 30 represented in dashed lined at FIGS. 1 and 2, and in continuous line at FIGS. 4-6, is provided.

In the embodiments of FIGS. 1-5, the stiffening band device consists in a single band element 30, however it can consist in several elements, like in the embodiment of FIG. 6, in which the stiffening band device 30 comprises two band elements (30*a*, 30*b*), provided that elements have a band like shape.

In FIG. 1 and in other embodiments, the stiffening band 30 is made of flexible material, and in the preferred embodiment, of the same flexible material as closure flap 20, so that it remains flexible even though it provides a stiffening effect.

The thickness of the stiffening band 30 is preferably within a range of 30 to 120 micrometers. Of course it is possible to use a thicker material. It is also advantageous that the thickness of the stiffening band remains in a range corresponding from 1.0 to 1.5 of the thickness of the flexible film 11. The same values apply to the thickness of the closure flap 20. These value ranges enable the stiffening band to provide a stiffening effect without excessively increasing the thickness of the packaging in the aperture area.

However it is important that the stiffening band adheres substantially uniformly through the top face 12 and over at least a major portion of the front and rear side faces (14, 15).

With that purpose, the stiffening band 30 is arranged coaxially to the direction of extension T of the closure flap and has an aperture 33 which matches with the container aperture 19. The stiffening band width is at least approximately equal to the width of the movable portion 22 of the closure flap in order to stiffen the peripheral area of the aperture 19 on which the closure flap 20 adheres. Only a few millimeters width reduction, as it appears on FIG. 4, can be allowed with regard to the width of the closure flap 20.

The stiffening band 30 has to extend beyond the longitudinal ends of the closure flap 20, i.e. to be longer than the closure flap in the direction of the pulling down action of the consumer. Indeed, it appears that the pulling action of the user in the transverse direction T may create deformations, like waves or wrinkles, to the flexible container 10. Thus it appeared important to stiffen the flexible container 10 in this direction and not merely over the peripheral area of the aperture 19. The stiffening band is bonded over the height of the front and rear side faces (14, 15), or at least an essential portion thereof, with that purpose, but also to provide a support function to the top face 12. In fact, the stiffening band creates a kind of legs along the side faces (14, 15) located on opposite sides of the container 10, which limit the tendency of the top face 12 to collapse when the packaging is nearly empty. Of course, that does not impede the consumer from flattening an empty package since the stiffening band 30 is not a rigid element. Nevertheless, the band 30 enables the package to keep approximately the initial shape of the flexible container 10 until the consumer exercises a gentle pulling down action on the gripping member 23 in a transverse direction somewhat parallel to the top face and finishes the pulling action by a downward movement to adhere the movable portion 22 to the upper portion of the front side face 14.

In the preferred embodiment, the stiffening band 30 further extends over the bottom face 13 up to two longitudinal straight ends (31, 32). The end portions of the band 30 bonded to the bottom face help maintain the cross-sectional profile of the flexible container 10 when the packaging is nearly empty, notably by maintaining the bottom face 13 relatively flat and by avoiding having the bottom portions of the rear end front faces (14, 15) drawing nearer. The end portions also contribute to the supporting function by acting like foot members which maintain the side face portions vertically.

It should be noticed that the ends (31, 32) of the stiffening band are located at a distance from the longitudinal sealing seam 18. This could be also seen on FIG. 4 in which the flexible film 11 is represented in a flattened condition and in which the portion corresponding to the different faces are indicated by braces. With that provision, the strip portion of the flexible film 11 which is folded over and hot sealed with the opposite edge of the flexible film pinched between the folds to form the longitudinal sealing 18, is free of any additional layer. Thus, longitudinal sealing step of the manufacturing process is exactly the same as for previous flexible containers. However, it is possible that the straight ends (31, 32) abut or overlap on the bottom face or even on another face.

Figure 3:
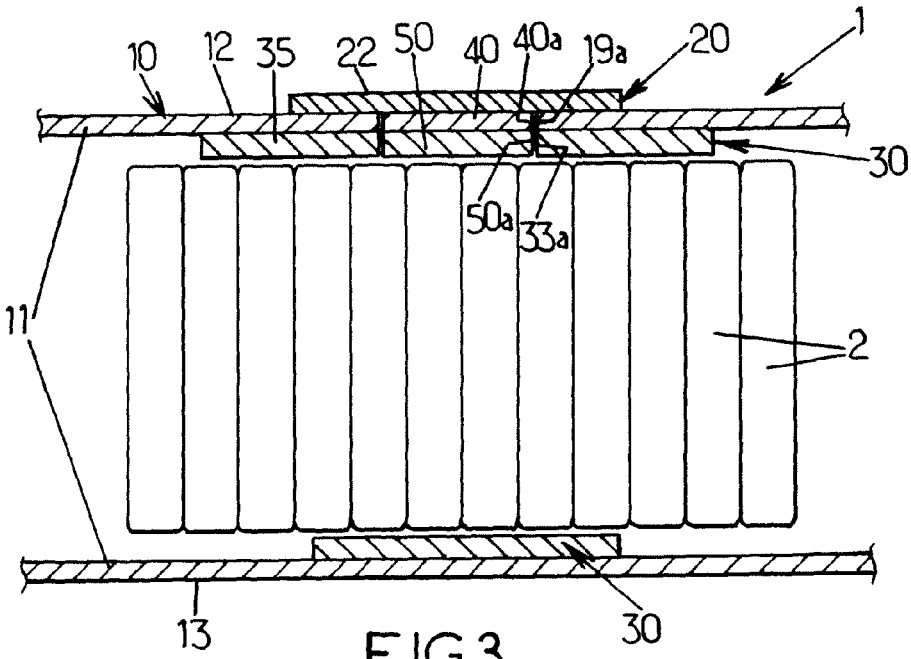
FIG. 3 is a partial cross-section view along the line III-III of the FIG. 2.

The stiffening band 30 is bonded to the inner side of the flexible film 11 forming the container 10, as it can be better seen at FIG. 3. It is conceivable to bond the stiffening band to the outer side of the flexible film, the closure flap being then adhered to the outer face of such a stiffening band. However, it appears that many advantages are obtained with the stiffening band 30 bonded to the inner side. It could be notably noted that an inner band has the advantage to let the external aspect of the packaging intact. The stiffening band 30 is transparent also with that purpose. With that disposition, the additional thickness created by both the closure flap 20 and the stiffening band 30, shares out between the inner and the outer sides of the flexible film 11. Consequently, in the preferred embodiment, each of these elements forms a step of less than 55 micrometers, taking into consideration the adhesive layer, which does not impede the transportation of the film in usual manufacturing machine, but which may not be the case with the step twice higher.

Bonding the stiffening band 30 on the inner side, also enables the stiffening band to bond with a repositionable adhesive, in particular with the same pressure sensitive adhesive as used with the closure flap 20, to simplify the manufacturing process. Accordingly, the consumer cannot readily peel off the stiffening band 30 from the inside of the container 10.

It should be noted that the aperture 33 of the stiffening band is delimited by a continuous cut out line 33*a* and preferably by an annular cut out.

In the preferred embodiment, the container aperture border 19*a* and the stiffening band aperture border 33*a* exactly superpose, without any misalignment due to the manufacturing process. However, slight dimensional variations and offset alignment between the band and the container apertures (19, 33) are admissible. In that case, it is preferable to design the band aperture 33 a little wider to avoid having the adhesive faces of the stiffening band 30 and the closure flap 20 come into direct contact.

The packaging is also provided with a container panel 40 visible on FIGS. 3 and 6, and with a stiffening panel 50 visible on FIGS. 1, 4 5 and 6. The closure panel 40 is cut from the flexible film 11 forming the container 10 by the cut out line 19*a* delimiting the aperture 19. Consequently, the container panel 40 is also delimited by a continuous cut out 40*a*. The flexible film forming the said panel 40 is exactly the same as the flexible film 11. Similarly, the stiffening panel 50 is cut from the stiffening band 30 and is delimited by a continuous cut out 50*a*. These panels (40, 50) are adhesively bonded together and to the movable portion 22 of the closure flap 20.

It should be also noticed that the fact of cutting the panels (40, 50) from the container 10 and the stiffening band 30 enables that they precisely fit within the container aperture 19 and the band aperture 33 in closed position.

The panels (40, 50) stiffen the central area of the movable portion 22 and limit the risk of crumpling the closure flap, which would be detrimental for the resealability of the packaging.

The container panel 40 also functions to hide the aperture 19 in closed position, which would be visible through the transparent closure flap 20. The stiffening panel 50 forms a central area free of adhesive which can come into contact with the food products. Nevertheless, this last function could be also provided by the container panel 40 and thus the stiffening panel 50 is not necessary to that purpose.

In a preferred embodiment, the stiffening panel 50 and the closure panel 40 have exactly the same shape and exactly overlap each other. It is possible to have some dimensional or alignment variations. However, it is highly preferable that said panels do not came into contact with the peripheral area of the aperture 19 when the closure flap 20 is pull down, in order to obtain a good tight seal.

The container panel 40 and the stiffening panel 50 can be delimited by U-shaped cut out lines since their side extending along the base portion 21 of the closure flap remains adjacent to the container and stiffening band corresponding portions. However, three layers of material at the movable portion 22 may form a resilient hinge which tends to maintain the movable portion 22 in an intermediate position between the closed position and a full open position. Therefore, it is preferable that the container panel 40 and the stiffening panel 50 are completely separated by an annular cut. Then, only the closure flap 20 forms a flexible hinge.

Referring to FIGS. 1-3, it can be noticed that the stiffening band 30 has a portion 35 which is larger in a width than the closure flap 20. The larger width portion 35 functions to stiffening the flexible container 10 in directions other than the longitudinal direction T of the band 30. It notably stiffens the peripheral area of the aperture 19 along the longitudinal direction X, but also along angled directions due to the round edge of that portion 35. In the embodiment of FIGS. 1-3, the larger width portion 35 is centered in the middle of the top face 12, which is also the middle of the aperture 19, to further stiffen the area of the flexible packaging which is the less supported when the packaging becomes empty.

Referring now to FIG. 4, representing a first alternative embodiment of the stiffening band 30, it could be noted that the large width portion 35 still has a round or circular profile, but is offset towards the gripping member 23, represented in dashed line because it is situated behind the flexible film 11. That arrangement of the larger width portion 35 favours the stiffening around the end of the closure flap 20 gripped by the consumer. Indeed, it appears that the consumers tend to apply a force toward the inside of the container 10 at the end of the pulling down action, and then it may be preferable to stiffen the corresponding portion of the packaging. Of course, it is possible to extend longitudinally the larger width portion 35 of the stiffening band to provide a further stiffening effect of the two embodiments described above.

FIG. 5 represents a second alternative embodiment of the stiffening band 30. In this embodiment, the stiffening band 30 has straight longitudinal edges 36. The constant width of the band does not exceed significantly the width of the closure flap 20. This embodiment saves flexible material since the scraps of film material, from which the stiffening bands are cut, can be significantly reduced. Moreover, tests show that the stiffening effect is still sufficient to enable one to reseal the packaging in a pretty tight manner, and notably to preserve the freshness of crackers during a few days, and even up to the best before date if the closure flap is carefully pulled out and down.

In that embodiment, the stiffening band 30 is about 10 mm wider than the closure flap 20 in order to guarantee that the area covered by the flap is stiffened, even if a misalignment between the inner band and the outer flap occurred. However, it is possible to adopt an equal width for the stiffening band, and even a slightly narrower width than the closure flap width.

FIG. 6 represents a third alternative embodiment of the stiffening band device 30 in which two band elements 30*a* and 30*b* form the stiffening device according to the preferred embodiment.

The bands 30*a* and 30*b* are made of the same flexible material as in the preceding embodiments and bonded to the flexible film 11 in the same manner. Each band (30*a*; 30*b*) is longer than the closure flap 20 and extends through the top, front and rear faces (12, 14, 15) along the transverse direction T of the packaging. This enables the bands to achieve the supporting function of the top face 12 and the stiffening effect in the direction corresponding to the consumer pulling action, in a way similar to preceding embodiments. However, it appears important to have band elements 30*a*, 30*b* on both sides of the container aperture 19, in order to stiffen the portion of the flexible container 10 comprised between the longitudinal sides of the closure flap 20 and the facing sides of the container aperture 19. That portion corresponds to the longitudinal portion of the peripheral area of the aperture 19 along which the consumer pulls.

In the embodiment of FIG. 6, the bands (30*a*, 30*b*) extend beyond the longitudinal edges of the closure flap 20, but the total width of the two bands is slightly lower than the width of the band 30 of FIG. 5. This saves flexible material. Further material saving can be obtained with straight outer edges 36 closer to the longitudinal sides of the closure flaps 20. It should be noted that the intensity of stiffening effect needed may vary from one kind of packaging to another one, and that an increase of the thickness of the band can improve it, in addition to the dimension thereof.

The front portion of the peripheral area between the bands (30*a*, 30*b*) is not stiffened, but it appears that a pretty good reseal can be obtained if the gripping member 23 is carefully pulled down at the end of the reclosing action. The opposite portion of the peripheral area is somewhat stiffened by the base portion 21 of the closure flap which remains adhered thereon. Consequently the sides of the aperture 19 are at the right distance when the reclosing action is initiated.

The two band elements (30*a*, 30*b*) of FIG. 6 also provide two stiffening panels 50 which are cut from said band by the annular cut 19*a* defining the aperture. Said panels 50 are much narrower than the single stiffening panel 50 of preceding embodiments. But they are arranged on a key area for the tightness of the reclosed packaging, i.e. along the longitudinal edges of the aperture 19. The stiffening panels 50 stiffen the movable portion 22 in addition to the container panel 40. However, it is possible to arrange the two band elements (30*a*, 30*b*) along the side edges of the aperture 19, and even at a few millimeters therefrom, so that each band (30*a*, 30*b*) has longitudinal straight edges on its sides. Then, no cut out has to be done through two layers of material.

The width, measured in direction of the longitudinal axis X of the aperture 19 represented at FIG. 6 is about 25 mm. That width corresponds approximatively to the thickness of five stacked food products 2 which can be withdrawn easily. However, tests were made with a wider aperture, notably with a width of 60 mm corresponding to the thickness fourteen food products. The stiffness provided by the bands (30*a*, 30*b*) remains sufficient to maintain the longitudinal edges of the aperture relatively flat and enabling a good resealability. With such a wide aperture the provision of two bands significantly reduces the flexible material needed. The main advantage of a wider aperture, having a width corresponding to 50% of the total length of the stack and up to 60% thereof, is that the products 2 remaining near the lateral faces 16 are much more easier to slide in front of the aperture 19. Then the consumer is less tempted to crumple the flexible container 10 to do the same, and consequently the resealability is preserved.

Figure 7:
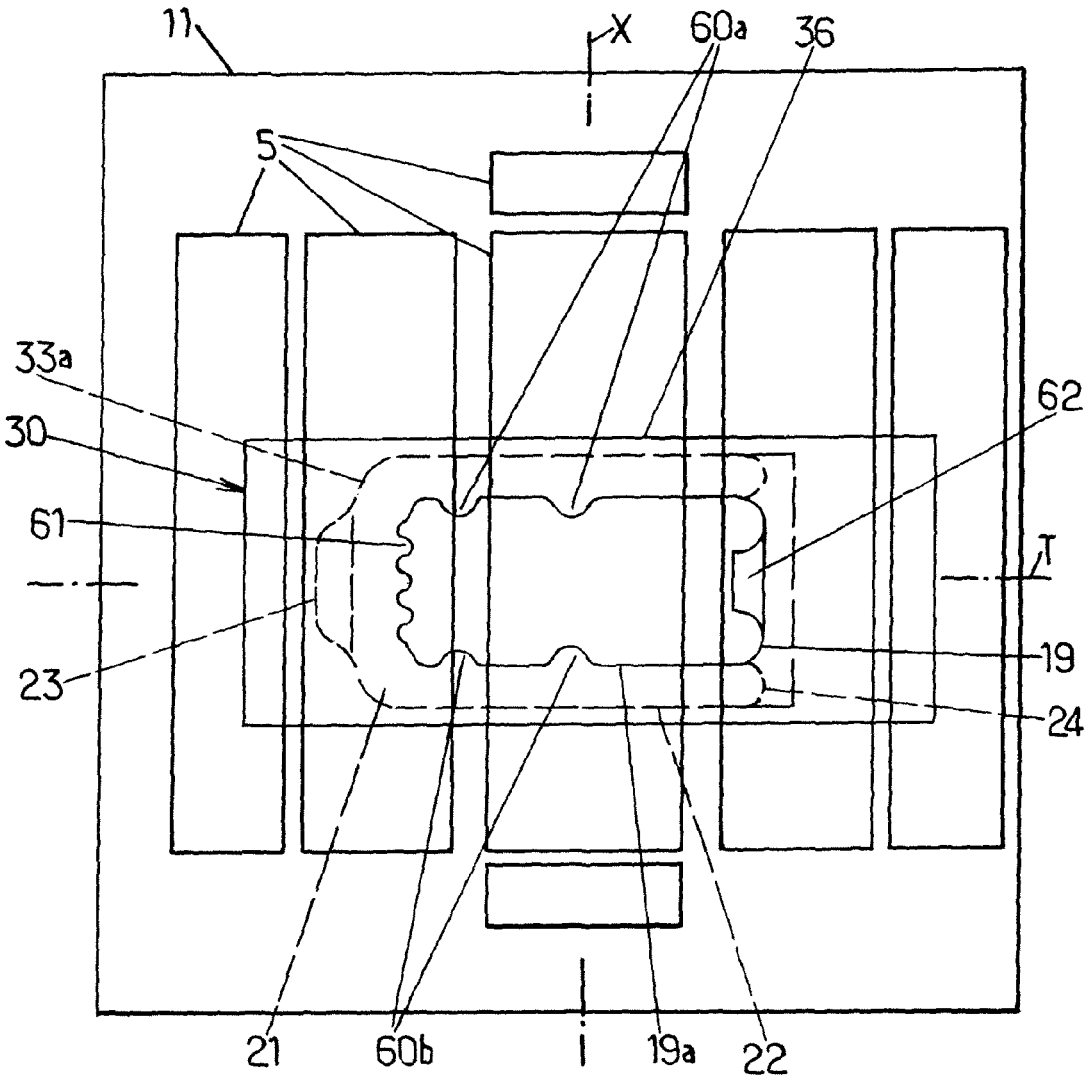
FIG. 7 is a similar view of the FIG. 5, showing an alternative embodiment of the cut out line delimiting the aperture.

Referring now to FIG. 7, it could be noted that the aperture 19 may be provided with a first opening indicating function. The cut out lines (19*a*, 33*a*) through the flexible film 11 may be undulated to define a little bit more complex profile of the aperture 19. The peripheral area of the aperture 19 here comprises first portions (60*a*, 60*b*) projecting inwardly according to the longitudinal axis X and second portions 61 projecting inwardly according to the transversal direction T. It will be understood that "inwardly" here means toward a central region of the aperture 19. Optionally, the stiffening panel(s) 50 may be removed in such an embodiment.

In this non-limitative example, the first and second portions (60*a*, 60*b*, 61) may have a rounded shape as shown in FIG. 7. The second portions 61 may be arranged next to each other, at a same side opposite to the base portion 21. The first portions (60*a*, 60*b*) are here bigger than the second portions 61 and more spaced. A third portion 62 projecting inwardly, at the opposite from the second portion, is fixed to the container panel 40 and reinforces the base portion 21 of the closure flap 20. This third projection 62 may be a portion of the stiffening element 30.

The cutting operation to define the aperture 19 is performed during the manufacturing process so that undulations are invisible or hardly visible until the first opening, by detachment of the closure flap 20. After the first opening, at least because of the flexibility of the closure flap 20 and difficulty to obtain an exact superposition between the first and second portions (60*a*, 60*b*, 61) and the corresponding slots defined in the container panel 40, the container panel 40 will not precisely fit within the aperture 19. More generally, use of specific protruding portions and/or slots to delimit the aperture 19 is useful as tamperproof means since after first opening, it is pretty impossible to set them exactly in place again. When the margin 25 of the closure flap 20 is in transparent material, the biscuits will be visible in some places.

Figure 8:
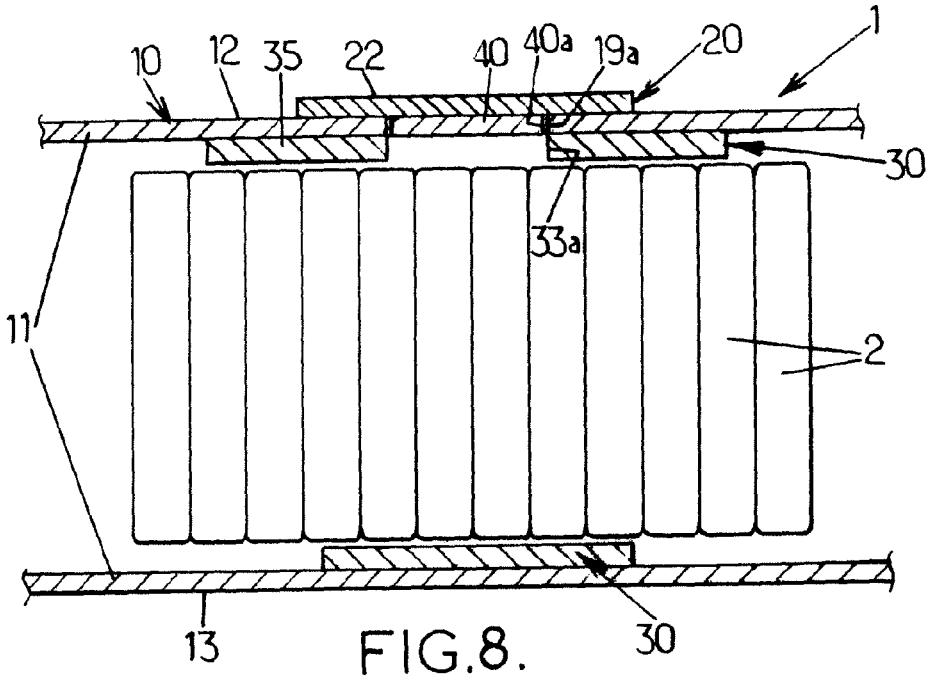
FIG. 8 is a similar view of the FIG. 3, showing an alternative embodiment, in which the stiffening band device is placed around the flap area.
Figure 9:
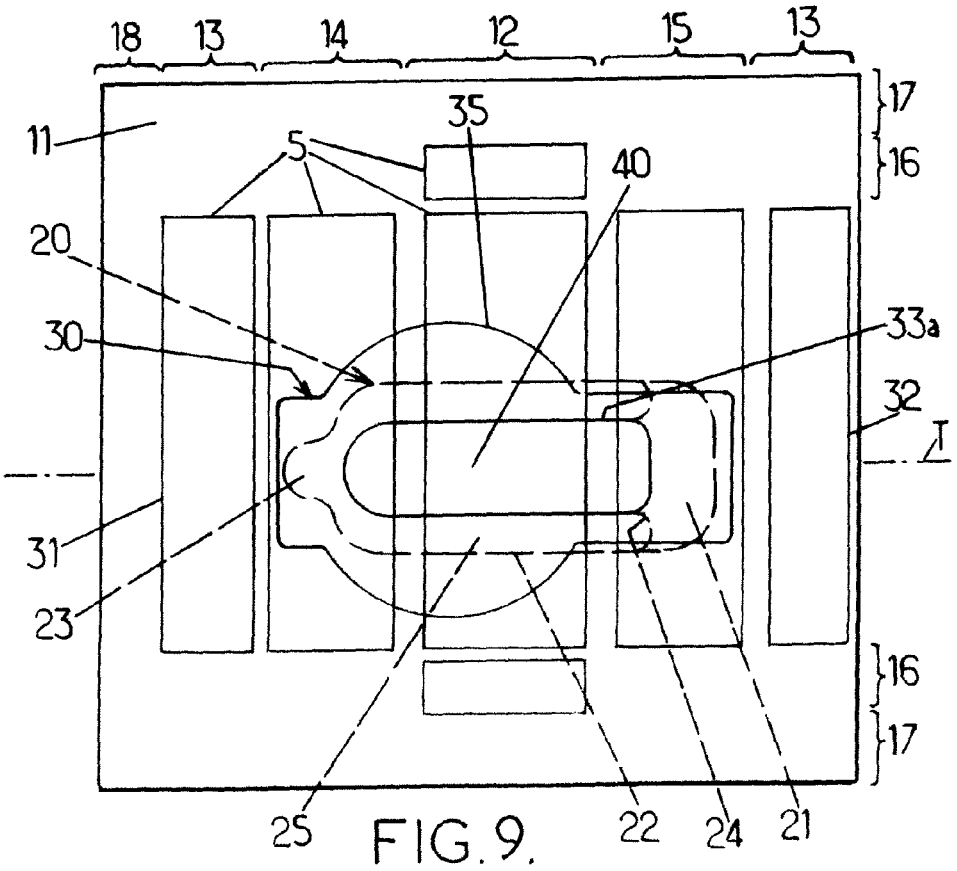
FIG. 9 is a similar view of the FIG. 4, showing a frame shape of the stiffening band device.

Of course, the different embodiments of the stiffening element 30 may be used in combination with any suitable shape of the aperture 19. For instance, referring to FIGS. 8 and 9, the stiffening band device 30 may define a frame arranged around the flap area. It is understood that the stiffening panel 50 is not present in such an embodiment. With such a shape of the stiffening band device, saving of material is obtained and the packaging 1 has lighter weight. Here, the stiffening band device 30 has an inner edge that extends around the aperture 19. In the figure, the inner edge is shown to be flush with the cut out line 19*a*, however, the inner edge may be configured to be slightly larger than the aperture 19 and thus the inner edge would be slightly offset and wider than the cut out line 19*a*. If desired, the stiffening band device may have inner edges which are parallel as shown in FIG. 9 or alternatively may be undulated (in the way shown in FIG. 7 when the container aperture border 19*a* and the stiffening band aperture border 33*a* exactly superpose in particular).

Figure 10:
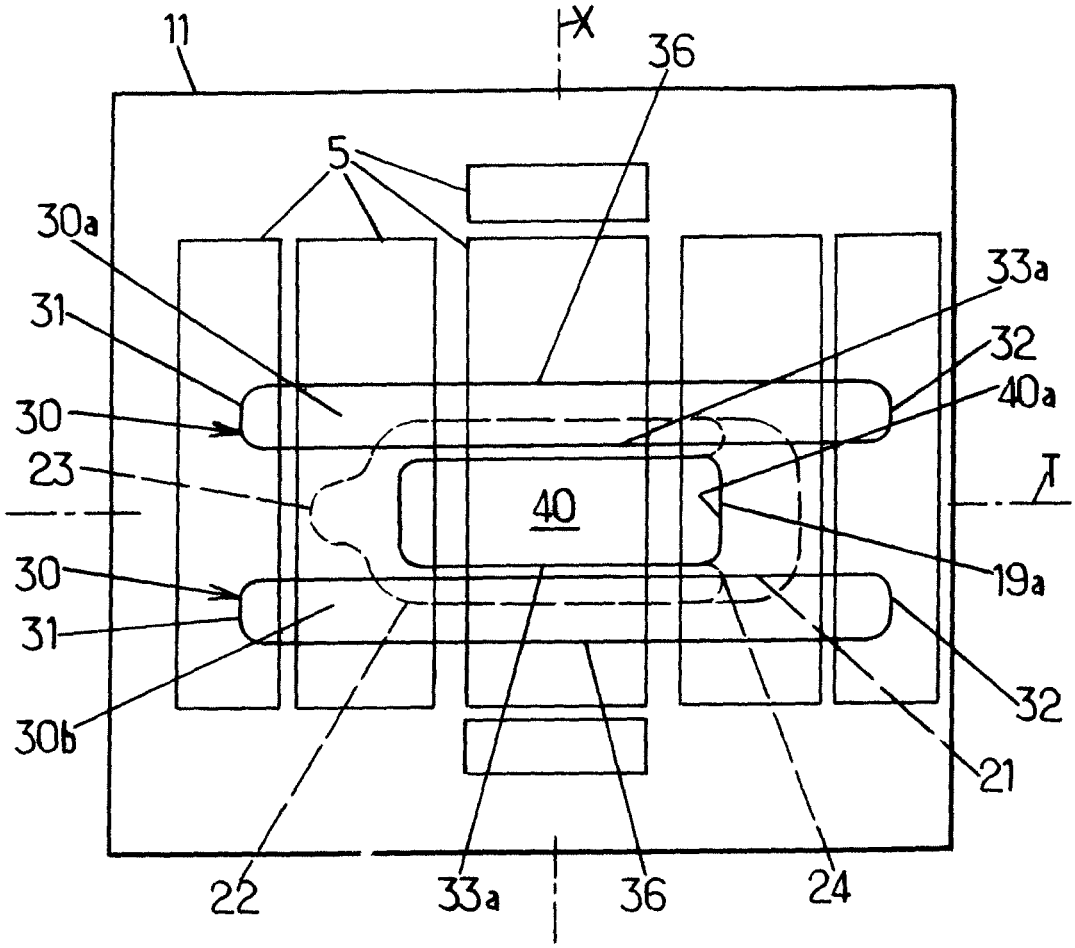
FIG. 10 is a similar view of the FIG. 6, showing another alternative embodiment, in which the stiffening band device is placed around the flap area.

Now referring to FIG. 10, the two strip embodiment as illustrated in FIG. 6 may be implemented with band elements (30*a*, 30*b*) which are spaced further apart. The cutting out to obtain the continuous cut out 40*a* of the portion 40 is performed through the thickness of the flexible film 11. It is understood that the two stiffening panels 50 shown in FIG. 6 are not present in such an alternative embodiment due to the band elements passing near to, but not through, the aperture 19. Accordingly, saving of material is obtained and pressure on knives and/or depth of knife blade may be advantageously reduced.

Various manufacturing process are possible for enabling the resealable closure according to the invention. It should be understood that one advantage of the invention is that most of the usual steps for manufacturing flexible containers can still be used without significant modification.

In order to obtain a perfect alignment of the cut out lines (19*a*, 33*a*) through the flexible film of the container 10 and through the material of the stiffening band 30, and then a perfect correspondence of the apertures (19, 33) and panels (40, 50) positions, it appears preferable that the manufacturing process comprises the following steps.

The flexible film previously printed is provided with the closure flap 20 on its outside face and with the stiffening band device 30 on its inside face. Said elements are preferably bonded, notably by a layer of adhesive. These elements can be attached to the film at the same time or during successive processing steps. Of course, the flap 20 and the band 30 must be located in positions which correspond to the container aperture 19 to be created in a further step by a cut out. These positions can be determined thanks to printed marks on the flexible film. It should be noticed that the closure flap and the stiffening band are not necessarily exactly in correspondence with each other, an offset of few millimeters in any direction being acceptable.

Then, further steps comprise cutting through the thickness of the inner band 30 and the thickness of the flexible film 11, forming the container at the same time along a line, which delimits simultaneously the container aperture 19 and the stiffening band aperture 33. Said line could be, of course, annular to obtain container and stiffening panels (40, 50) completely cut and exactly fitting within the apertures. During that cutting step, the closure panel 20 should not be cut out, but a slight reduction of thickness along the cut out line is acceptable. Such a cutting through two layers, but not through the third one, can be realized in a die cutting process or laser cutting process.

The detailed description here above is not limitative, various modifications can be adopted in addition to those mentioned above. The possible modifications depend notably on the kind of food products to be contained within the packaging.

The invention claimed is:

1. A resealable packaging for food products, comprising:

a flexible container formed by a flexible film, said container having a top face, a bottom face and side faces, a container aperture extending at least within the top face and being wide enough for withdrawing a food product, a closure flap adhered to a first surface of the flexible film, the closure flap made of a flexible material and extending longitudinally from a base portion designed to remain bonded to the container to a gripping member, and provided therebetween with a movable portion covered of repositionable adhesive which is peelable from a closed position in which said movable portion covers the container aperture and adheres to a peripheral area thereof, a stiffening layer made of a flexible material longer than the closure flap, said layer being attached to a second surface of the flexible film on at least the top face and at least over two side faces and being arranged to cover at least the portions of the peripheral area comprised between the longitudinal sides of the closure flap and the facing sides of the container aperture, and in that said container aperture and said stiffening layer in the peripheral area of the aperture, are delimited by continuous cut out lines, said container extending along a total length between two container ends, wherein the width of the container aperture is less than 60% of the total length, and wherein outer edges of the stiffening layer are located in close proximity to the container aperture, such that the width between the stiffening layer outer edges is substantially smaller than the total length such that space for a plurality of food products is provided between the stiffening layer outer edges and the two container ends.

2. The resealable packaging of claim 1, wherein the flexible film forming the container has an inner and an outer side, the stiffening layer being bonded to the inner side of the flexible film.

3. The resealable packaging of claim 1, wherein the flexible container extends along a longitudinal axis between two opposite side faces on which the flexible film is sealed, and wherein the closure flap and the stiffening layer coaxially extends along a transversal direction with respect to the longitudinal axis.

4. The resealable packaging of claim 1, wherein the stiffening layer is further bonded over at least a portion of the bottom face.

5. The resealable packaging of claim 1, wherein the flexible container has a sealing seam extending through the bottom face, and wherein the stiffening layer is extended up to ends which are bonded to the bottom face at a distance from the sealing seam.

6. The resealable packaging of claim 1, wherein a container panel cut from the container flexible film adheres to the movable portion of the closure flap, and wherein a stiffening panel made of a flexible material is bonded to the container panel, said container and stiffening panels being arranged to fit within the container and stiffening band apertures in the closed position.

7. The resealable packaging of claim 1, wherein the flexible material forming the stiffening layer is a plastic film having a thickness comprised within a range of 30 to 120 micrometers.

8. The resealable packaging of claim 7, wherein the plastic film forming the stiffening layer has a thickness of about 50 micrometers.

9. The resealable packaging of claim 1, wherein the flexible material forming the stiffening layer has a thickness comprised between 100% to 150% of the thickness of the flexible film forming the container.

10. The resealable packaging of claim 9, wherein the flexible material forming the stiffening layer has a thickness of about 120% of the thickness of the flexible film.

11. The resealable packaging of claim 1, wherein the stiffening layer is covered with a repositionable adhesive which bonds said stiffening layer to the inner side of the container.

12. The resealable packaging of claim 1, wherein the stiffening layer is transparent.

13. The resealable packaging of claim 1, wherein the stiffening layer has a portion of larger width which is arranged at least partially over the inner side of the top face.

14. The resealable packaging of claim 1, wherein the stiffening layer has longitudinal straight edges.

15. The resealable packaging of claim 1, wherein said stiffening layer comprises a single band, said band being at least substantially wide as the closure flap and having a band aperture arranged to correspond the container aperture.

16. The resealable packaging of claim 15, wherein the container and the band apertures are delimited by a continuous annular cut out.

17. The resealable packaging of claim 1, wherein said stiffening layer comprises at least two band elements arranged on each side of the container aperture at a distance from each other.

18. The resealable packaging of claim 1, wherein the flexible container contains a stack of flat food products, the width of the container aperture being greater than the thickness of five food products and smaller than 60% total length of the stack.

19. The resealable packaging of claim 1, wherein the container aperture extends through the top face and over an upper portion of the two side faces, said upper portions having a height smaller than one third of the total height of said side faces.

20. The resealable packaging of claim 1, wherein the stiffening band is up to 10 mm wider on each side of the closure flap.

21. The resealable packaging of claim 1, wherein the peripheral area up to 15 mm wider around the aperture.

22. The resealable packaging of claim 1, wherein the adhesive between the closure flap and the packaging is the same as the adhesive between the stiffening layer and the packaging.

23. The resealable packaging of claim 1, wherein the container aperture is provided with at least one opening indicating function by comprising portions of the flexible film projecting inwardly towards a central region of the container aperture.

* * * * *